US010378308B2

(12) United States Patent
Moffitt

(10) Patent No.: US 10,378,308 B2
(45) Date of Patent: Aug. 13, 2019

(54) ONE TRIP LINER DRILLING AND CEMENTING

(71) Applicant: Schlumberger Technology Corporation, Sugar Land, TX (US)

(72) Inventor: Michael Eric Moffitt, Kingwood, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 385 days.

(21) Appl. No.: 15/199,755

(22) Filed: Jun. 30, 2016

(65) Prior Publication Data

US 2016/0312574 A1 Oct. 27, 2016

Related U.S. Application Data

(63) Continuation-in-part of application No. PCT/US2015/011699, filed on Jan. 16, 2015.
(Continued)

(51) Int. Cl.
*E21B 33/14* (2006.01)
*E21B 34/12* (2006.01)
(Continued)

(52) U.S. Cl.
CPC ..... *E21B 33/14* (2013.01); *E21B 7/20* (2013.01); *E21B 21/10* (2013.01); *E21B 34/12* (2013.01); *E21B 43/10* (2013.01); *E21B 10/26* (2013.01); *E21B 47/18* (2013.01); *E21B 2034/005* (2013.01)

(58) Field of Classification Search
CPC ..... E21B 33/14; E21B 10/64; E21B 43/10; E21B 34/12; E21B 7/00; E21B 33/12; E21B 4/02; E21B 7/20; E21B 21/10; E21B 2034/005; E21B 47/18; E21B 10/26
See application file for complete search history.

(56) References Cited

U.S. PATENT DOCUMENTS 8,276,689 B2 * 10/2012 Giroux ..... E21B 7/20 175/171
2004/0003944 A1 1/2004 Vincent et al.
(Continued)

OTHER PUBLICATIONS

International Preliminary Report on Patentability issued in related PCT application PCT/US2015/011699 dated Aug. 4, 2016, 7 pages.
(Continued)

*Primary Examiner* — Michael R Wills, III

(57) ABSTRACT

A liner drilling system and method to at least partially drill a wellbore with a liner and cement the liner in place in the wellbore, in a single downhole trip. An example system includes a liner releasably coupled to a drill string. The drill string extends through an axial bore of the liner and a downhole end includes a bottomhole assembly and a drill bit that rotate to drill a portion of a wellbore. A liner annulus is formed between the drill string and the liner. An annulus isolator is coupled to the liner and isolates flow within the bore of the liner from flowing through at least a portion of a wellbore annulus between the liner and the wellbore. A diverter in the drill string is positioned uphole of the bottomhole assembly and establishes a cement flow path into the liner annulus.

19 Claims, 22 Drawing Sheets

Related U.S. Application Data

(60) Provisional application No. 61/929,494, filed on Jan. 20, 2014.

(51) Int. Cl.

| | |
|---|---|
| ***E21B 43/10*** | (2006.01) |
| ***E21B 21/10*** | (2006.01) |
| ***E21B 7/20*** | (2006.01) |
| *E21B 10/26* | (2006.01) |
| *E21B 47/18* | (2012.01) |
| *E21B 34/00* | (2006.01) |

(56) References Cited

U.S. PATENT DOCUMENTS

| | | | | |
|---|---|---|---|---|
| 2011/0203794 | A1* | 8/2011 | Moffitt | E21B 7/20 166/285 |
| 2012/0168228 | A1 | 7/2012 | Giroux et al. | |
| 2012/0186816 | A1 | 7/2012 | Dirksen et al. | |
| 2012/0279705 | A1* | 11/2012 | Moffitt | E21B 33/14 166/285 |
| 2013/0043020 | A1 | 2/2013 | Eriksen | |
| 2013/0299169 | A1 | 11/2013 | Rex et al. | |
| 2015/0068805 | A1* | 3/2015 | Eriksen | E21B 47/09 175/45 |
| 2016/0312586 | A1* | 10/2016 | De Clute-Melancon | E21B 33/14 |

OTHER PUBLICATIONS

International Search Report and Written Opinion in International Patent Application No. PCT/US2015/011699, dated Apr. 29, 2015, Korean Intellectual Property Office, Daejeon Metropolitan City, Republic of Korea, 10 pages.

* cited by examiner

ONE TRIP LINER DRILLING AND CEMENTING

CROSS-REFERENCE TO RELATED APPLICATIONS

This application is a continuation-in-part of International Patent Application No. PCT/US2015/011699, filed on Jan. 16, 2015, which claims priority to, and the benefit of, U.S. Patent Application No. 61/929,494, filed on Jan. 20, 2014. Each of the foregoing applications is expressly incorporated herein by this reference in its entirety.

BACKGROUND

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than a full string of casing. The liner is made up of joints of pipe in the same manner as casing. Also, the liner is normally cemented into the well. The liner, however, does not extend back to the wellhead assembly at the surface. Rather, the top of the liner is secured by a liner hanger to the casing string just above the lower end portion of the casing. The operator may later install a tieback string of casing that extends from the wellhead downward into engagement with the liner hanger assembly.

When installing a liner, the operator drills the well to the desired depth, retrieves the drill string, and then assembles the liner. A liner top packer may be incorporated into the liner, and during liner make-up, a cement shoe or float collar with a check valve is secured to the lower end portion of the liner. When the desired length of liner is assembled, the operator attaches a liner top assembly (e.g., liner hanger, setting collar top, running tool profile adaptor, liner top packer, tieback receptacle (polished bore receptacle), and a releasable running tool) to the upper end portion of the liner. The operator then runs the liner and liner top assembly into the wellbore on a string of drill pipe attached to the running tool. The operator positions the liner top assembly at the lower end of the casing and pumps cement through the drill pipe, down the liner, and back up an annulus surrounding the liner.

SUMMARY

According to some embodiments of the present disclosure, a method of drilling includes drilling at least a portion of a wellbore while running a liner into the wellbore. The liner is coupled to a drill string extending through a bore of the liner. The drill string is coupled to a drill bit, and a liner annulus is defined radially between the drill string and the liner. The bore of the liner is isolated from a wellbore annulus radially between the liner and the wellbore, and a downhole cement path is established using a diverter, and through a bore of the drill string into the liner annulus. The liner is hung from a liner hanger within the wellbore, and the liner is decoupled from the drill string. Cement is pumped along a cement path extending downhole through the liner annulus and at least partially uphole into the wellbore annulus. A displacement fluid is pumped along the cement path to displace the cement into the wellbore annulus and cement the liner in place. The drill string and drill bit are withdrawn from the wellbore, such that the method is accomplished in a single downhole trip.

According to some embodiments, a system for drilling with liner and cementing the liner in place in a single trip includes a liner releasably coupled to a drill string. The drill string extends through an axial bore of the liner and a downhole end includes a bottomhole assembly and a drill bit that rotate to drill a portion of a wellbore. A liner annulus is formed between the drill string and the liner. An annulus isolator is coupled to the liner and isolates flow within the bore of the liner from flowing through at least a portion of a wellbore annulus between the liner and the wellbore. A diverter in the drill string is positioned uphole of the bottomhole assembly and establishes a cement flow path into the liner annulus.

This summary is provided to introduce a selection of concepts in a simplified form that are further described below in the detailed description section. The summary is not intended to be used to limit the scope of the claimed subject matter.

BRIEF DESCRIPTION OF THE DRAWINGS

Embodiments of various devices, systems, tools, and methods will hereafter be described with reference to the accompanying drawings. It should be understood, however, that the accompanying drawings illustrate various embodiments described herein and are not meant to limit the scope of various techniques and components disclosed herein. Except for drawings identified as schematic, the drawings are to scale for some embodiments, and therefore may be used to show relative dimensions of various components. Such drawings are not, however, to scale for each embodiment contemplated, and thus do not limit the embodiments of the present disclosure to any particular size, scale, or the like.

FIG. 16-1 is a schematic, side view of an annulus isolator that may be employed in the system of FIG. 15, according to one or more embodiments.

FIGS. 16-2 to 16-4 are schematic, side views of the annulus isolator of FIG. 16-1 during various stages of use, according to one or more embodiments.

FIG. 18-1 is a schematic, side view of still another annulus isolator that may be employed in the system of FIG. 15, according to one or more embodiments.

FIGS. 18-2 to 18-4 are schematic, side views of the annulus isolator of FIG. 18-1 during various stages of use, according to one or more embodiments.

DETAILED DESCRIPTION

Figure 1:
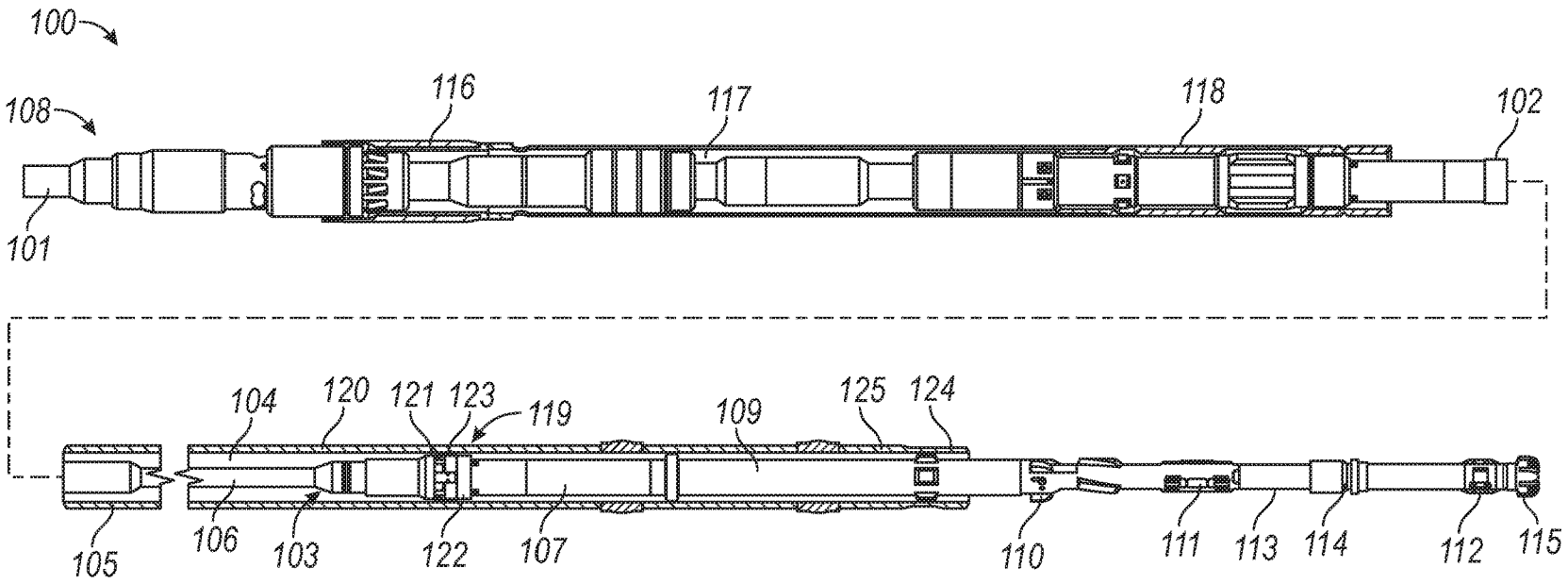
FIG. 1 is a partial cross-sectional view of a system for liner drilling and cementing in a single trip, according to one or more embodiments.

Some embodiments of the present disclosure relate to subsurface drilling. More specifically, some embodiments of the present disclosure relate to drilling while simultaneously conveying casing or a liner into a wellbore.

The discussion below is directed to certain specific embodiments. It is to be understood that the discussion below is for the purpose of enabling a person with ordinary skill in the art to make and use any subject matter defined now or later by the patent "claims" found in any issued patent herein.

It is specifically intended that the claims not be limited to the embodiments and illustrations contained herein, but include modified forms of those embodiments including portions of the embodiments and combinations of elements of different embodiments as come within the scope of the following claims.

Reference will now be made in detail to various embodiments, examples of which are illustrated in the accompanying drawings and figures. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, apparatuses and systems have not been described in detail so as not to obscure aspects of the embodiments.

It will also be understood that, although the terms first, second, etc. may be used herein to describe various elements, these elements should not be limited by these terms. These terms are used to distinguish one element from another. For example, a first object could be termed a second object, and, similarly, a second object could be termed a first object, without departing from the scope of the claims. The first object and the second object are both objects, respectively, but they are not to be considered the same object.

The terminology used in the description of the present disclosure herein is for the purpose of describing particular embodiments and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses one or more possible combinations of one or more of the associated listed items. It will be further understood that the terms "includes" and/or "including," when used in this specification, specify the presence of stated features, operations, elements, and/or components, but do not preclude the presence or addition of one or more other features, operations, elements, components and/or groups thereof.

As used herein, the terms "up" and "down"; "upper" and "lower"; "upwardly" and downwardly"; "below" and "above"; and other similar terms indicating relative positions above or below a given point or element may be used in connection with some embodiments of various technologies described herein. However, when applied to equipment and methods for use in wells or boreholes that are deviated or horizontal, or when applied to equipment and methods that when arranged in a well or borehole are in a deviated or horizontal orientation, such terms may refer to a left to right, right to left, or other relationships as appropriate.

Various embodiments will now be described in more detail with reference to Figures. FIG. 1, for instance, depicts one embodiment of a system 100 used in the various techniques for one trip liner drilling and cementing. As illustrated, a string of drill pipe 101 includes or is coupled to an upper diverter 102. The upper diverter sub 102 permits fluid flowing downward through the drill pipe 101 to the bottomhole assembly 103 to be diverted and circulated through an annulus 104 between a liner 105 and the drill pipe 101. One or more collapsible subs 106 may be coupled to the drill pipe 101. As shown, one or more collapsible subs 106 are positioned between the upper diverter sub 102 and a lower diverter sub 107, but may be positioned anywhere between or within the running tool 108 and the bottomhole assembly 103. The lower diverter sub 107 permits cement (or any fluid) flowing downward through the drill pipe 101 to bypass the interior of the bottomhole assembly 103 by flowing into the annulus 104 between the liner 105 and drill pipe 101 (and potentially between the liner 105 and an outside portion of the bottomhole assembly 103). The drill pipe 101 may also have coupled thereto a downhole motor 109 such as a mud motor or turbine. The bottomhole assembly 103, which may include an underreamer 110, a roller reamer 111, a rotary steerable system 112, a measurement-while-drilling (MWD) system 113, other components, or any combination of the foregoing, may be coupled to the drill pipe 101 farther downhole. As shown, the bottomhole assembly 103 may also include a second reamer 114 coupled to the drill pipe 101 proximate a drill bit 115 at the bottom end portion of the drill pipe 101 and the bottomhole assembly 103. In some embodiments, the second reamer 114 may be referred to as a rathole eliminator reamer, or near-bit reamer.

The system 100 may also include a liner hanger 116 (e.g., a multi-set or single-set liner hanger), although some embodiments may not include a liner hanger. Additional or other components of the system 100 may include a polished bore receptacle 117 and a liner profile nipple 118 coupled to the liner 105. A bottomhole assembly indicator system 119 may also be employed as shown in FIG. 1. The liner 105 may include a bottomhole assembly (bottomhole assembly) position indicator sub 120 with one or more grooves 121 on an inner surface thereof. The drill pipe 101 has a bottomhole assembly position indicator housing 122 with, e.g., expandable members 123 such as spring-loaded dogs, expandable slips, or the like. The expandable members 123 may engage or mate with the one or more grooves 121 on the inner surface of the bottomhole assembly position indicator sub 120 when the drill pipe 101 is lowered and extended through the liner 105. The bottomhole assembly position indicator sub 120 is positioned a distance above a liner shoe 124 and the bottomhole assembly position indicator housing 122 is positioned a distance above the bottomhole assembly 130 such that when the bottomhole assembly position indicator housing 122 mates with the bottomhole assembly position indicator sub 120, the bottomhole assembly 103 is properly positioned relative to the liner 105.

Positioned downhole of the bottomhole assembly position indicator sub 120, a cement port collar 125 may be coupled to the liner 105 to divert cement flow from inside the liner 105 to the outside of the liner 105. In one or more embodiments, an annulus isolator 126 (see FIG. 6) is coupled to a bottom end portion of the liner 107 to mitigate cement flow upward into the liner 105. In one or more other embodiments, the annulus isolator 126 may be coupled to the drill pipe 101. In yet one or more other embodiments, the annulus isolator 126 may have components coupled to the liner 105 and to the drill pipe 101 that cooperate to mitigate cement flow upward into the liner 105, or the annulus isolator 126 may be coupled to the liner 105 to mitigate cement flow upward into an annulus between the liner 105 and the wellbore.

One or more embodiments of methods of using the system 100 of FIG. 1 to drill while tripping the liner 105 into the wellbore, and to cement the liner 105 in a single trip will now be described.

Figure 2:
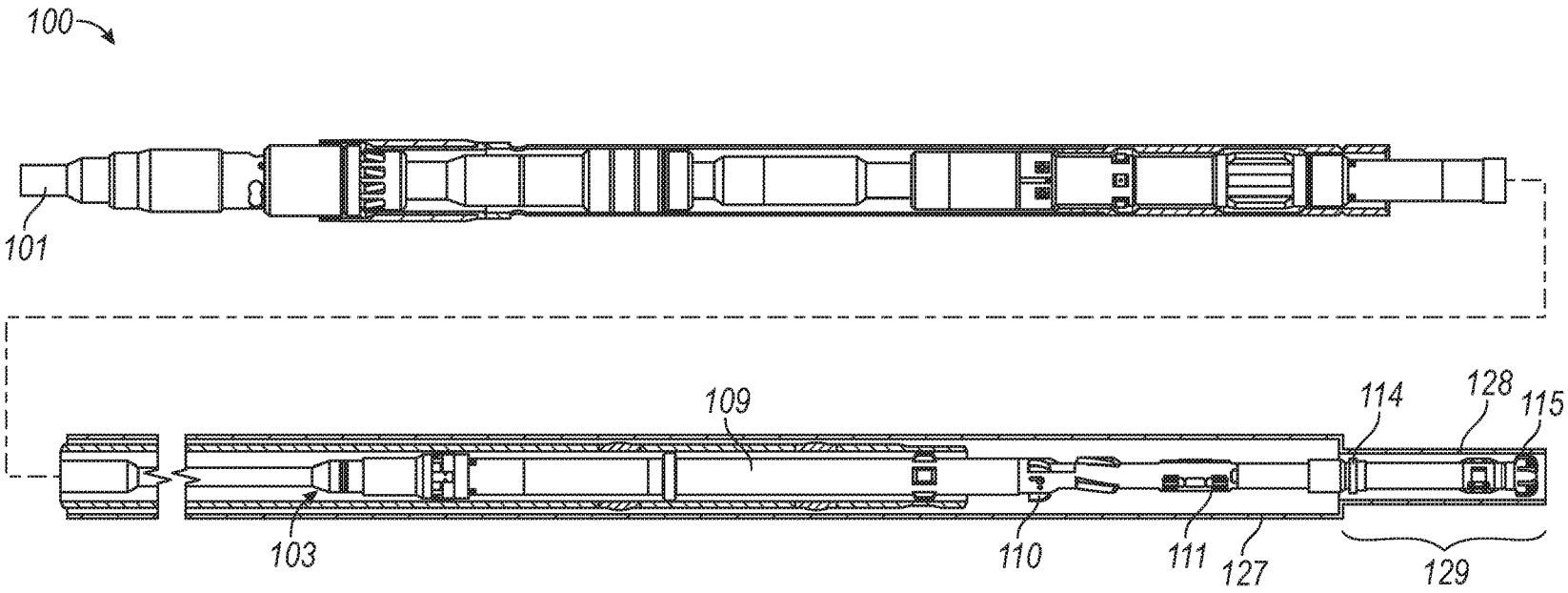
FIGS. 2-13 are partial cross-sectional views of the system of FIG. 1 during performance of a method for liner drilling and cementing in a single trip, according to one or more embodiments.

FIG. 2 illustrates a method of employing the system 100 of FIG. 1 to ream a pilot hole 128 of a wellbore 127 after liner drilling to total depth. The drill bit 115 at the bottom end portion of the drill pipe 101 drills (e.g., rotated by the downhole motor 109 coupled thereto) the pilot hole 128, which is a drilled hole having a diameter substantially that of the drill bit 115. The underreamer 110 and/or roller reamer 111 may be employed to support the bottomhole assembly 103 while drilling the wellbore 127, and to potentially expand diameter of the pilot hole 128. The position of the underreamer 110 and/or roller reamer 111 above the drill bit 115 will, however, leave some distance of the pilot hole 128 as un-reamed. This un-reamed pilot hole is referred to as the rat hole 129. The second reamer 114, or rat hole eliminator reamer, is another reamer that may be placed closer in proximity to the drill bit 115. Upon reaching total depth when liner drilling, the drill pipe 101 is moved uphole such that the rat hole eliminator reamer 114 may be actuated in the previously reamed (i.e., enlarged diameter) hole provided by the underreamer 110 and/or roller reamer 111. The drill pipe 101 is then lowered downhole with the rat hole eliminator reamer 114 actuated until the drill bit 115 hits total depth. Thus, at least a portion of the previous rat hole 129 is eliminated or widened (e.g., in this embodiment about equivalent to the distance between the lower positioned underreamer 110 or roller reamer 111 and the rotary steerable system 112) with a small distance of the rat hole 129 remaining. The remaining portion of the rat hole 129 may be about equivalent to the distance between the rat hole eliminator reamer 114 and the face of the drill bit 115. After reaming the pilot hole 128 until the drill bit 115 hits total depth, the rat hole eliminator reamer 114 is then de-actuated. In one or more other embodiments, the rat hole 129 is not reamed after the initial pilot hole 128 is drilled.

Figure 3:
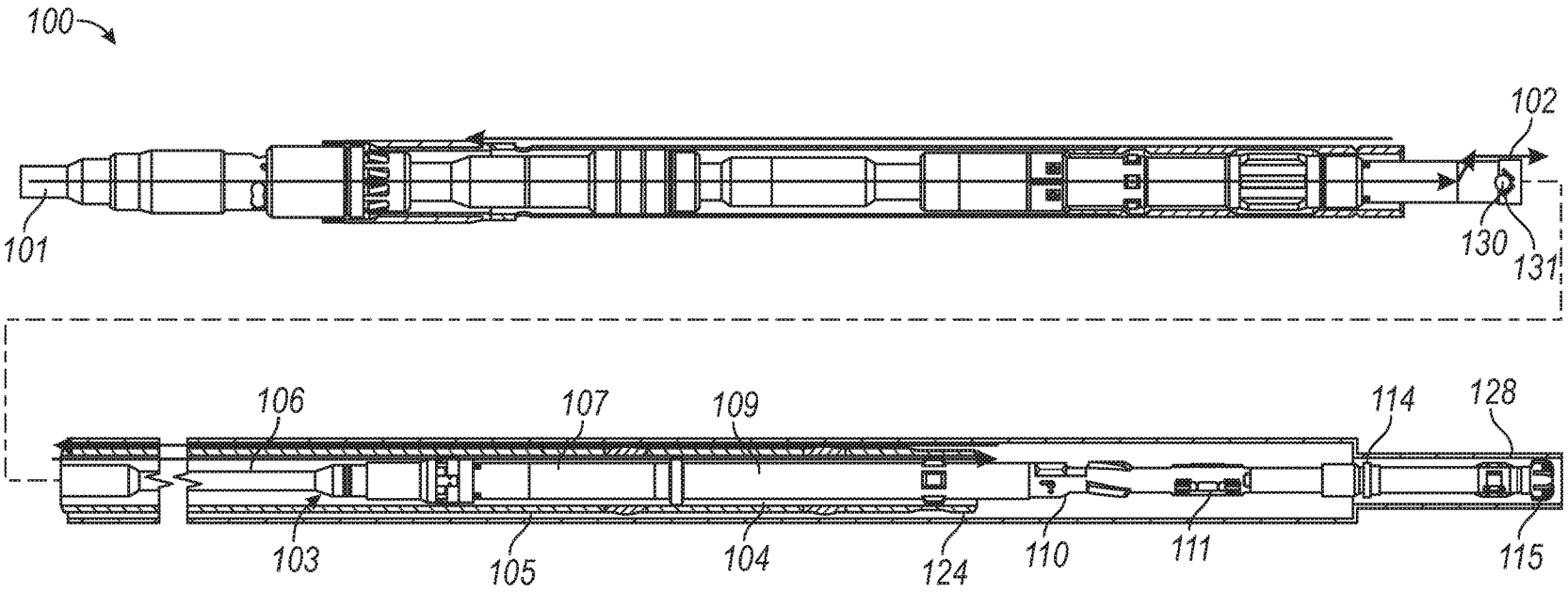

FIG. 3 illustrates a method of employing the system 100 of FIG. 1 to flush the liner 105. Such method may be employed after reaming the pilot hole 128 with the rat hole eliminator reamer 114 as shown in FIG. 2. To flush the inside bore of the liner 105, a ball, dart, electromagnetic device (e.g., RFID tag) or other actuation device 130 may be dropped, e.g., from surface, through the drill pipe 101 to the upper diverter sub 102, or a signal may be conveyed from the surface or a downhole controller (e.g., using mud pulse telemetry, wired drill pipe, pressure pulses, etc.). The dropping of an actuation device 130 or use of other actuation mechanism may be used in tandem with another physical function (e.g., rotation, picking up, or slacking off) to transition the rat hole eliminator reamer 114 (or other tool) into an active or inactive state. An actuation device 130 such as a ball may seat on a ball seat 131 coupled to the upper diverter sub 102, which may restrict fluid flow therethrough. The increased fluid pressure can cause the upper diverter sub 102 to actuate (e.g., by shearing a shear pin to open a valve), thereby opening a fluid bypass from the bore of the drill pipe 101 to the annulus 104 between the liner 105 and the drill pipe 101. The bypass fluid flow is then diverted downward through the annulus 104, around the bottomhole assembly 103 and out (or downhole) of the liner shoe 124. The fluid flow thus bypasses the downhole motor 109 such that the downhole motor 109 is static, the drill bit 115 does not rotate to drill, and the various reamers 110, 111, 114 remain unactuated with their reamer arms or blocks in a retracted or collapsed state. The fluid flow through the annulus 104 serves to flush or clean out any gas or debris, such as cuttings, that may be present in the bore of the liner 105 below the upper diverter sub 102. In one or more other embodiments, an upper diverter sub 102 is not employed to flush the bore of the liner 105.

Figure 4:
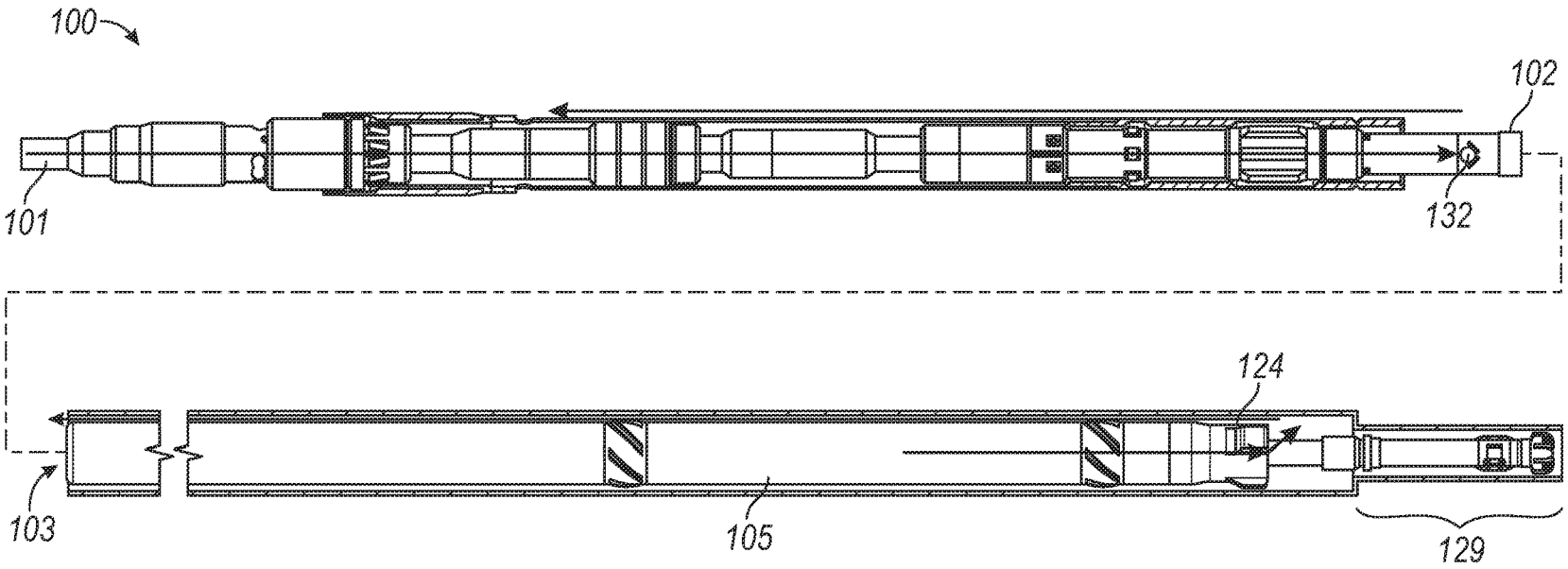
Figure 5:
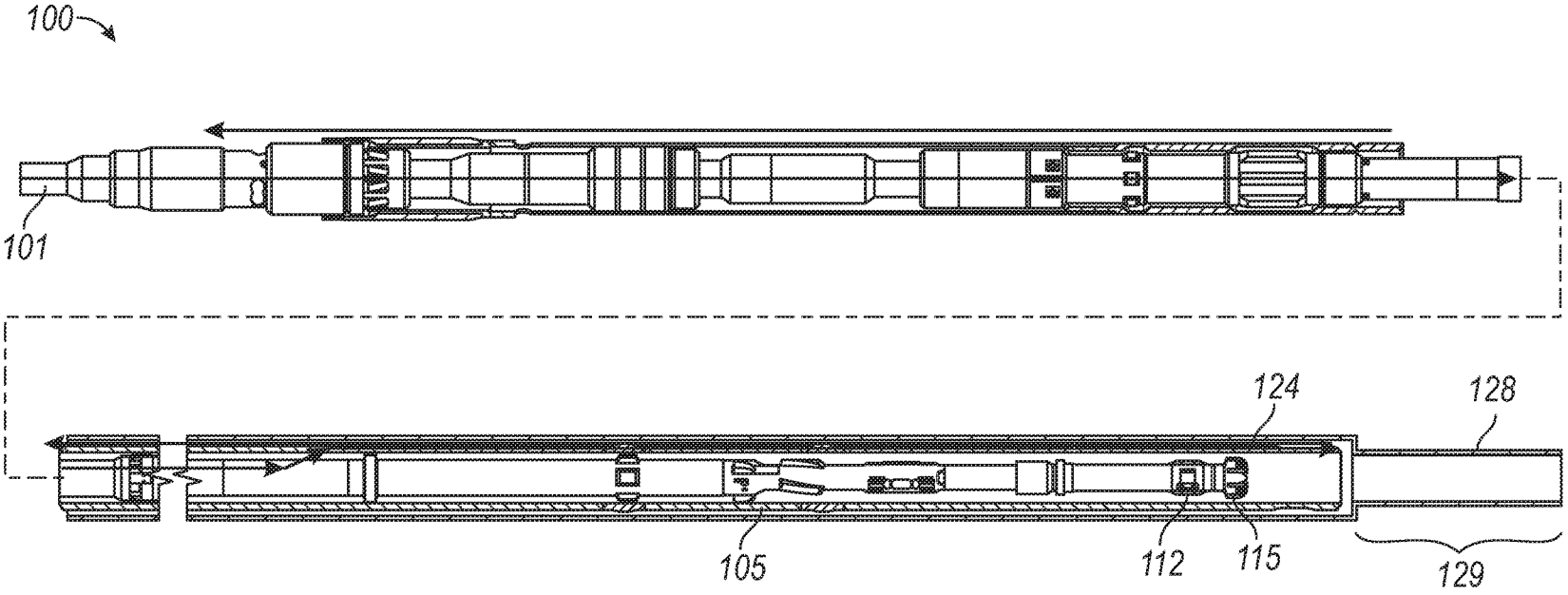

FIG. 4 illustrates a method of employing the system 100 of FIG. 1 to cover the rat hole 129. In this method, a ball, dart, electromagnetic device, or other actuation device 132 is dropped downhole, or a wireless or other signal is conveyed, to deactuate the upper diverter sub 102 into a closed position, if such upper diverter sub 102 is actuated into an open or diverting position. Where an actuation device 132 is used, the same or a different ball, dart, electromagnetic device, or other actuation device 132 may drop further downhole within the bore of the liner 105 to actuate the lower diverter sub 107 into its diverting position. Actuation and de-actuation of the upper diverter sub 102 may also be accomplished by manipulating the drill pipe 101 (e.g., set down, pick up, rotate, etc.) with the first actuation device 130 (see FIG. 3) in place or having passed down through the drill pipe 101 to be disposed at or near the lower diverter 107 (see FIG. 3). The collapsible subs 106 (see FIG. 3) are actuated to reduce the length of the drill pipe 101, thereby lowering the liner 105 over the bottomhole assembly 103. Such lowering of the liner 105 also causes the liner 105 to "cover" the rat hole 129. In other words, the liner 105 is lowered into proximity with rat hole 129 such that the liner 105 and/or liner shoe 124 encloses or nearly encloses or is adjacent the rat hole 129, as shown in FIG. 5. Fluid flow diverted by the lower diverter sub 107 washes the bore of the liner 105 downward around the bottomhole assembly 103 to the liner shoe 124. The liner shoe 124 is washed to the ledge to cover the underreamed section (which can also be done prior to deactivating the upper diverter sub 102 and activating the lower diverter sub 107). In one or more other embodiments, the rat hole 129 is left uncovered.

FIG. 5 illustrates the system 100 of FIG. 1 as employed to ream the remainder of a rat hole 129 to pilot hole total depth using cutting structures on the liner shoe 124 (e.g., a reamer shoe). In this way, the liner 105 and liner shoe 124 coupled to an end portion thereof cover or envelop the remainder of the rotary steerable system 112 and drill bit 115 that were left in the pilot hole 128. In one or more other embodiments, the drill pipe 101 may be raised uphole relative to the liner 105 such that the rotary steerable system 112 and drill bit 115 are covered by (i.e., retracted into the bore of) the liner 105 and liner shoe 124.

Figure 6:
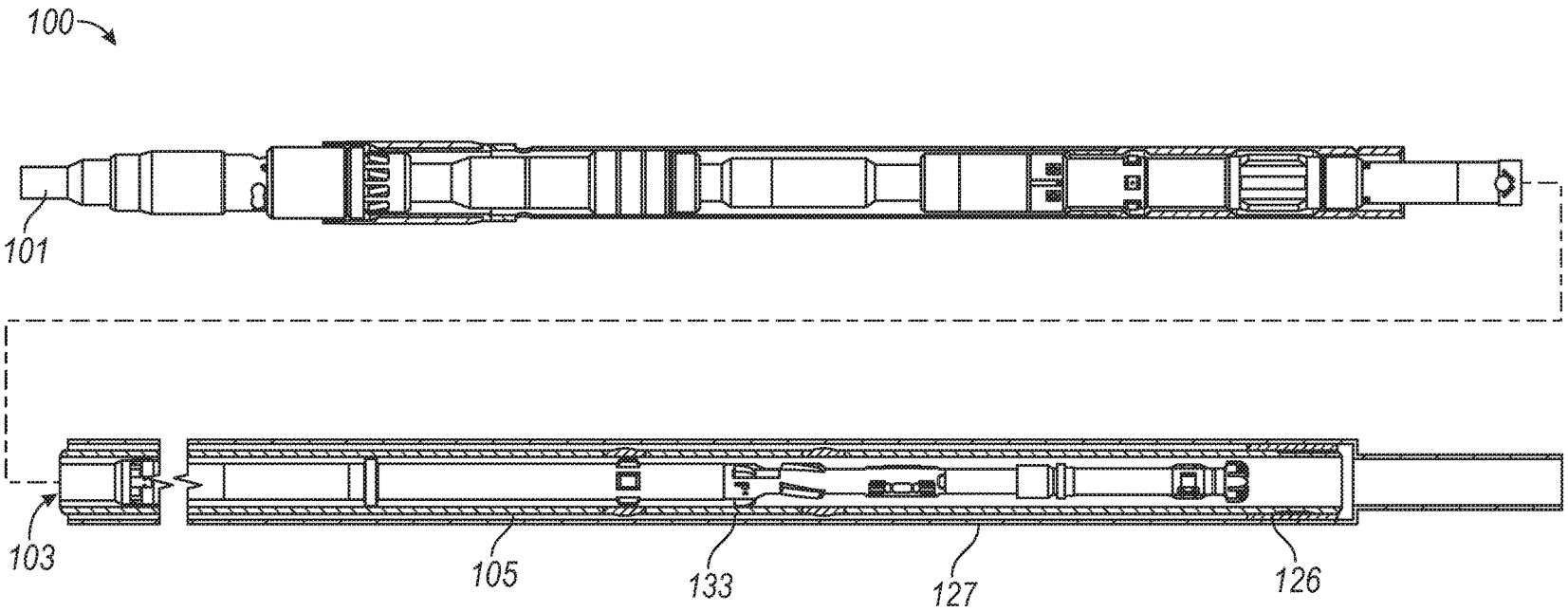

FIG. 6 illustrates the system of 100 of FIG. 1 as employed to isolate the bore of the liner 105 from an annulus 133 between the outer surface of the liner 105 and the wall of the wellbore 127. In this configuration and method, the annulus isolator 126 is activated to seal off the bore of the liner 105 from the annulus 133 (i.e., create a fluid barrier restricting or even preventing fluid flow from the bore of the liner 105 into a portion of the annulus 133). Such isolation facilitates pulling the bottomhole assembly 103 out of the hole after cementing, without causing cement to be suctioned into the bore of the liner 105 from the annulus 133. The annulus isolator 126 may be activated in any manner known to those skilled in the art including, but not limited to, using set down weight of the drill pipe 101, using hydraulic fluid pressure, using a downhole activation motor, using valves controlled by hydraulic fluid, using valves controlled by electrical signals (e.g., a pressure pulse signal can be interpreted by a processor which can use a battery to trigger the valve), using RFID tags pumped down from surface, other activation tools, or any combination of the foregoing. One example of an annulus isolator 126 may be an inflatable annular casing packer on the outer surface of the liner 105 near the bottom end portion thereof. Cement or other fluid may be used to activate/inflate the annular casing packer of the annulus isolator 126 to effectively seal the annulus 133 above such packer relative to the bore of the liner 105. The annulus isolator 126 described above is one example. Another annulus isolator 126 may be a solid expandable tubular. The solid expandable tubular is a radially expandable metal pipe or sleeve that increases in outer diameter to seal the liner 105 by engaging the inner wall of the wellbore 127. This operation may be performed inside of a casing as a patch or liner hanger. Such solid expandable tubulars may be deployed hydraulically, mechanically (via a piston), or by setting down on the liner shoe 124 to drive a cone under the solid expandable tubular to force it to expand. Other embodiments of annulus isolation will be described hereinafter.

Figure 7:
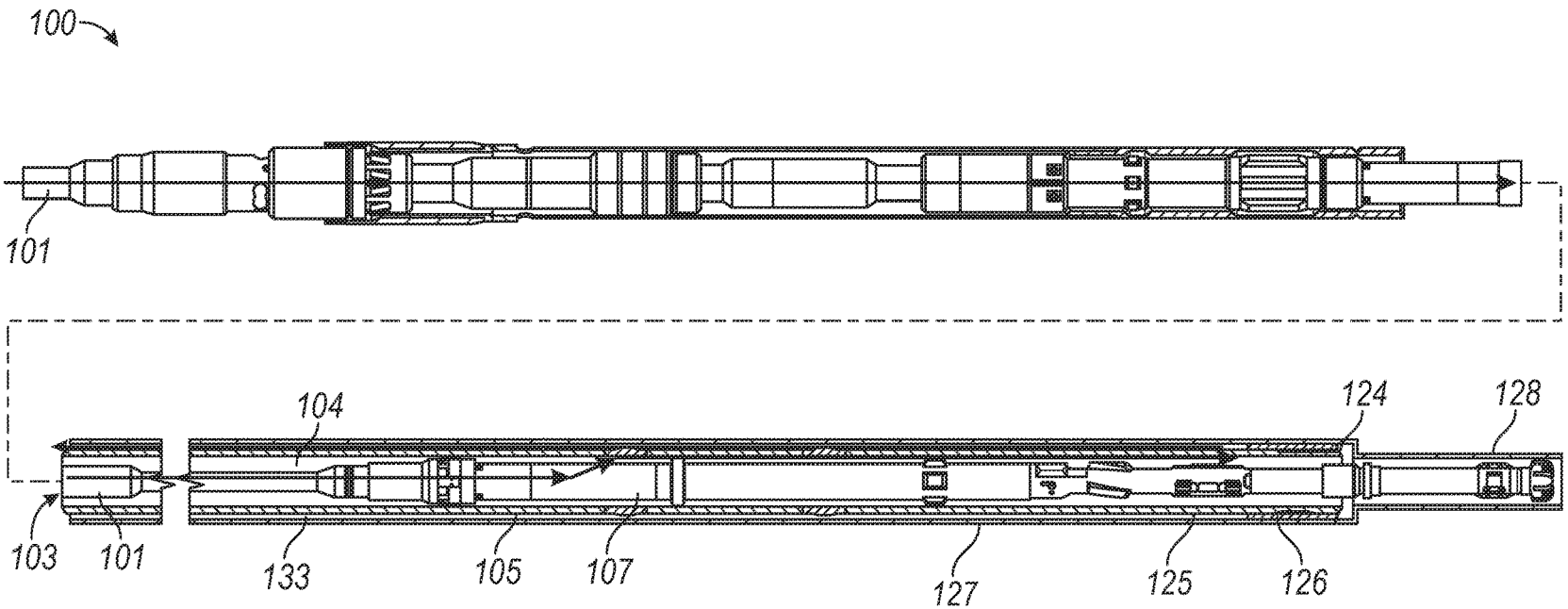

FIG. 7 the system 100 of FIG. 1 as it may be employed to establish a flow path for cementing. In the illustrated configuration, a cement port collar 125 may be hydraulically or mechanically activated. As described herein, the cement port collar 125 may be coupled to the liner 105 and used to divert cement flow from inside the liner 105 to the outside of the liner 105. The cement port collar 125 may also be incorporated into the body of the annulus isolator 126. If the cement port collar 125 is hydraulically activated, fluid pressure in the drill pipe 101, out the lower diverter 107 and in the annulus 104 between the drill pipe 101 and liner 105 is increased (i.e., increased against the liner shoe 124). This increased pressure creates a differential pressure that causes the cement port collar 125 to open, thereby permitting fluid flow therethrough. As a large differential pressure may not occur proximate the cement port collar 125 during drilling—for example, due to the annulus 104 between the liner 105 and drill pipe 101 being open to the annulus 133 between the liner 105 and the wellbore 127—the liner shoe 124 may be planted into the bottom surface of the pilot hole 128 or the annulus isolator 126 activated in order to create such differential pressure. If the cement port collar 125 is mechanically activated, the drill pipe 101 may be manipulated to mechanically actuate the cement port collar 125 into its open position. The annulus isolator 126 may also be set concurrently with the setting down of the drill pipe 101 against the liner shoe 124. The annulus isolator 126, the cement port collar 125, or both, may be actuated by placing the liner shoe 124 against the formation. A fluid (e.g., cement) flow path is thus established down the inner string of drill pipe 101, outward through the lower diverter 107, downward through the annulus 104 between the drill pipe 101 and the liner 105, outward through the cement port collar 125, into the annulus 133 between the liner 105 and the wellbore 127, and up to the parent casing.

Figure 8:
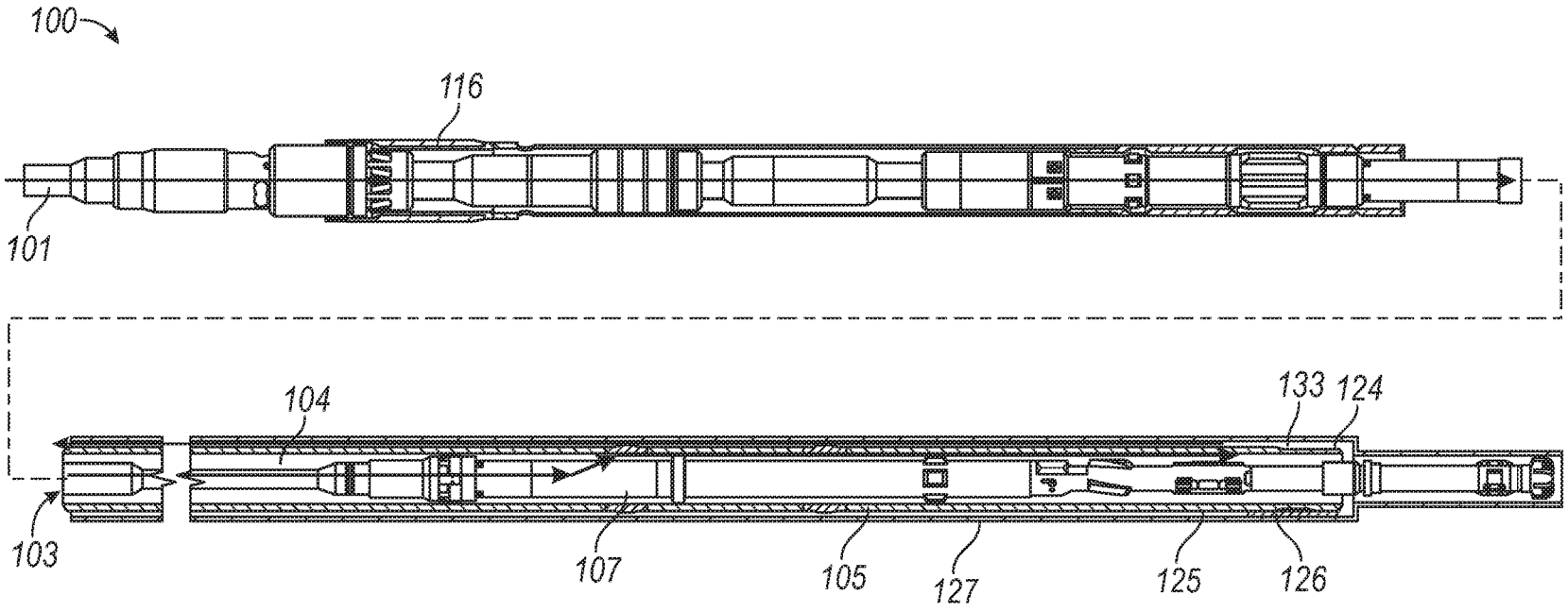

FIG. 8 illustrates the system 100 of FIG. 1 as employed in a method to release the liner 105 and cement. In this example method, the drill pipe 101 is picked up or raised slightly off bottom to set the liner hanger 116. The drill pipe 101 is then released from the liner 105. Drilling fluid or cement circulation may be then be commenced along a pathway through the inner string of drill pipe 101, radially outward through the lower diverter 107, downhole/downward through the annulus 104 between the liner 105 and the drill pipe 101, radially outward through the cement port collar 125, and into the annulus 133 between the liner 105 and the wellbore 127. Once in the annulus 133, the cement or other fluid may move in an uphole/upward direction as shown in FIG. 8, toward the parent casing in the wellbore 127. A person having ordinary skill in the art should appreciate, in view of the disclosure herein, that rotation of the liner 105 is possible with a cement swivel and v-packing or similar assembly proximate the liner shoe 124.

Figure 9:
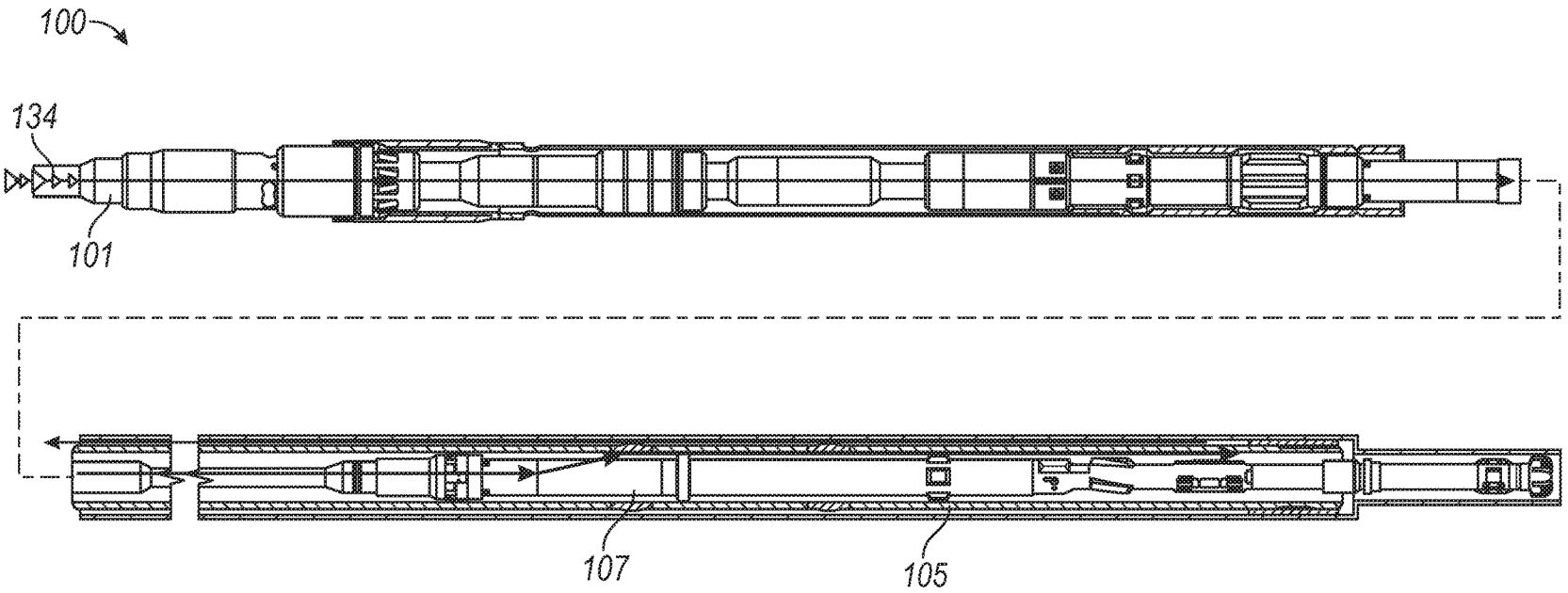

FIG. 9 illustrates the system 100 of FIG. 1 as used in a method that includes terminating cementing operations. In this illustrative method, an obstruction device such as a ball or dart 134 is dropped and pumped downhole through the drill pipe 101. The dart 134 or other obstruction device is thus dropped behind or uphole of the cement. A displacement fluid is then pumped downhole behind or uphole of the dart 134, and used to move both the dart 134 and the cement in the downhole/downward direction. The movement of the dart 134 downhole through the drill pipe 101 serves to wipe or clean at least some of the cement from the cementing flow path within the drill pipe 101, and downhole to the lower diverter 107. Dual cementing plugs may be deployed in the system 100 if desired to isolate fully the cement during pumping and displacement methods.

Figure 10:
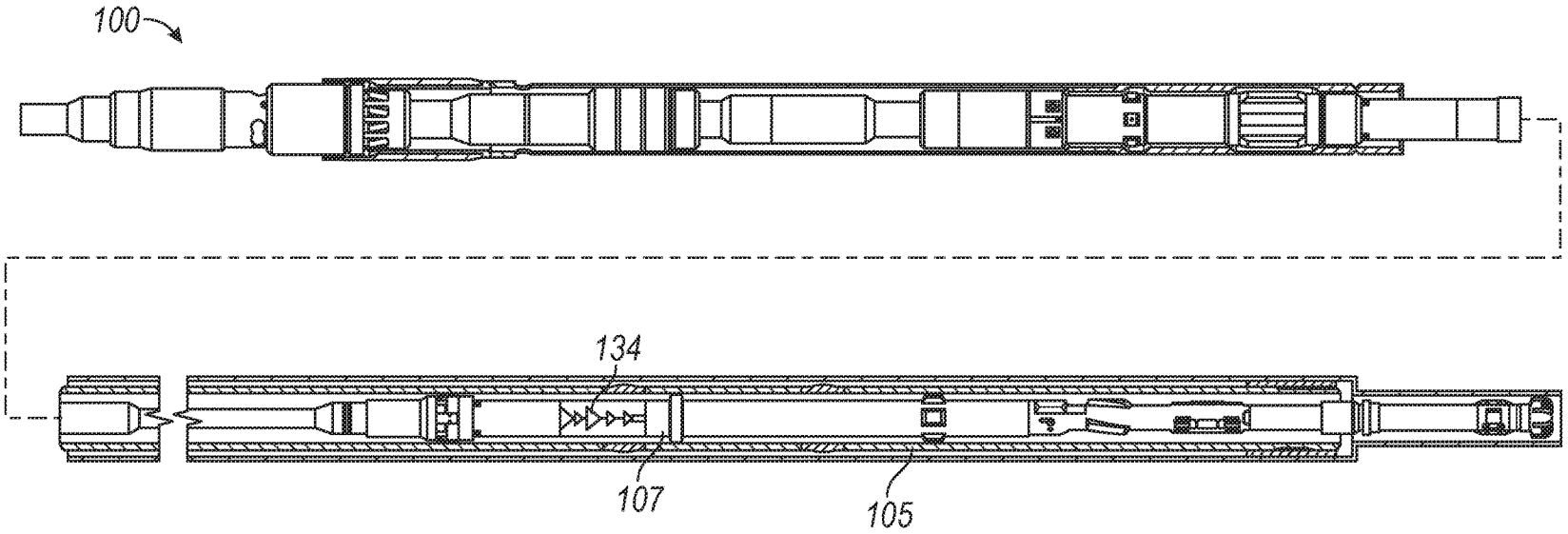

FIG. 10 illustrates the system 100 of FIG. 1 as employed in a method that includes confirming full displacement of cement from the cementing flow path in the inner string of the drill pipe 101 to the lower diverter 107. When the dart 134 of FIG. 9 lands into a corresponding profile in the bore of the lower diverter 107, the dart 134 bumps, lands, or latches into the lower diverter 107 and may cause a plugging of the lower diverter 107. As a result, fluid pressure may build and increase uphole of the landed dart 134. This increase in fluid pressure signals the full displacement of cement from the cementing flow path downhole to the lower diverter 107. The signal may thus represent full cement displacement from the bore of the drill string, including the bore of the liner running tool 108, and the bore of the drill pipe 101.

Figure 11:
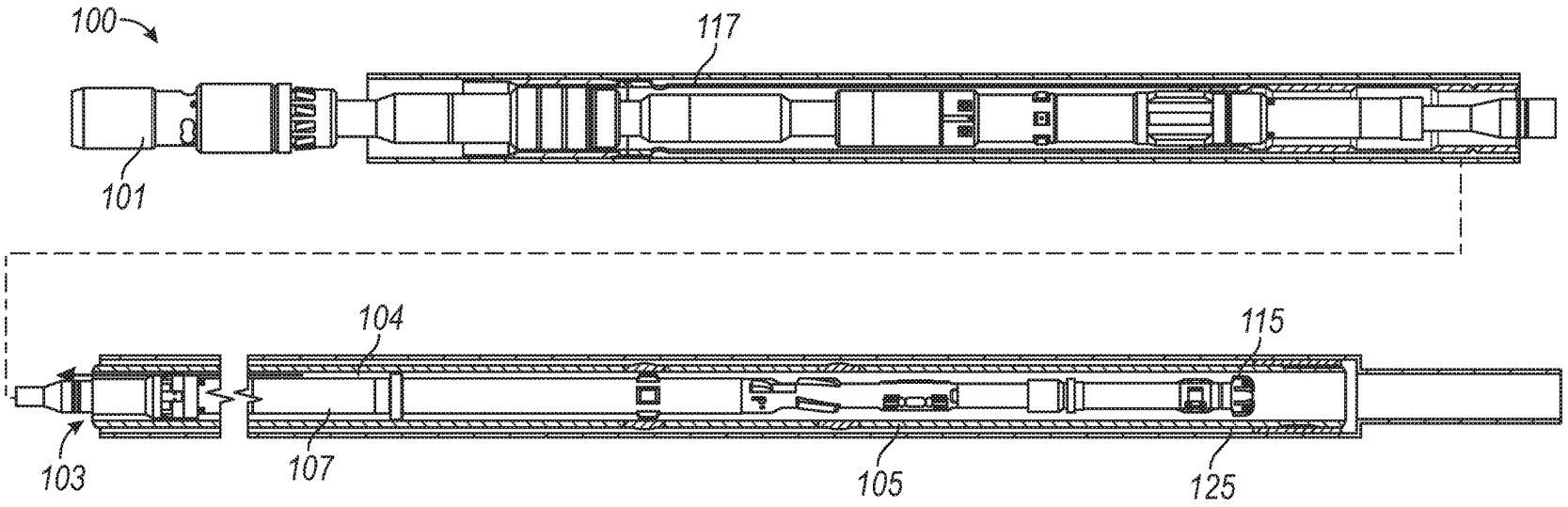

FIG. 11 illustrates the system 100 of FIG. 1 as employed in a method that includes closing the cement port collar 125 and re-establishing fluid circulation through the drill pipe 101. In this configuration, the drill string/drill pipe 101 is picked up or raised, and an upper pack-off may be removed from the polished bore receptacle 117. This pick up or raising of the drill string/drill pipe 101 may cause the cement port collar 125 to close (e.g., via a closing device positioned above or uphole of the bottomhole assembly 103). The closing device may include or be a lip, protrusion, or other radial structure coupled to the drill pipe 101 that mechanically interacts with, e.g., physically contacts, the cement port collar 125 of the liner 105 to transition the cement port collar 125 from an open position to a closed position. The fluid pressure in the bore of the drill pipe 101 may then be increased to cause the landed dart 134 (see FIG. 10) in the lower diverter 107 to move the lower diverter 107 from a non-diverting position to a diverting position (e.g., by the breaking of shear pins and axial movement of a dart seat). The shifting of the lower diverter 107 from non-diverting to diverting may be effectuated by, for example, the landed dart 134 being forced at least partially through the lower diverter 107 in response to increased fluid pressure. Those skilled in the art will readily recognize in view of the disclosure that other devices, e.g., electrical, etc., may be employed to operate the lower diverter 107. Once the lower diverter 107 is once again diverting fluid into the annulus 104 between the liner 105 and the drill pipe 101, fluid may then be circulated downhole through the drill pipe 101, diverted into the annulus 104 between the liner 105 and drill pipe 101, and back to the top of the liner 105. This opening in the lower diverter 107 also permits fluid communication between the drill pipe 101 of the drill string and the annulus 104 such that the drill string evacuates fluid while being pulled out of the hole to minimize mud spillage on the rig floor. In another embodiment (not shown), the fluid pressure in the bore of the drill pipe 101 may be increased to cause the landed dart 134 (see FIG. 10) to move such that fluid flow may be re-established through the lower diverter 107, through the bottomhole assembly 103, and out the drill bit 115, if desired.

Figure 12:
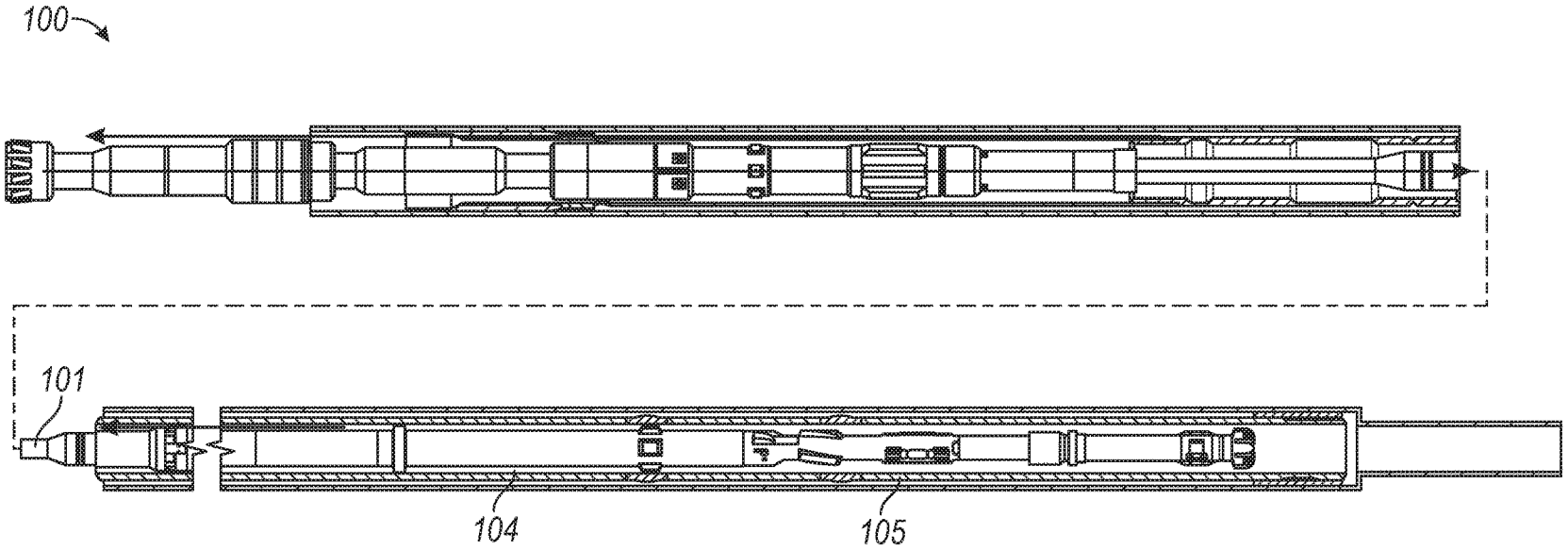

FIG. 12 illustrates the system 100 of FIG. 1 as employed in a method that includes re-establishing flow through the drill pipe 101, into the annulus 104 between the drill pipe 101 and liner 105, and back to the top of the liner 105, as described in greater detail with respect to FIG. 11. Any excess cement proximate the bottom end portion of the liner 105 may then be circulated uphole through the annulus 104 between the liner 105 and the drill pipe 101. Further, any excess cement proximate the top end portion of the liner 101 may then be circulated uphole through the annulus between the drill string and the parent casing.

Figure 13:
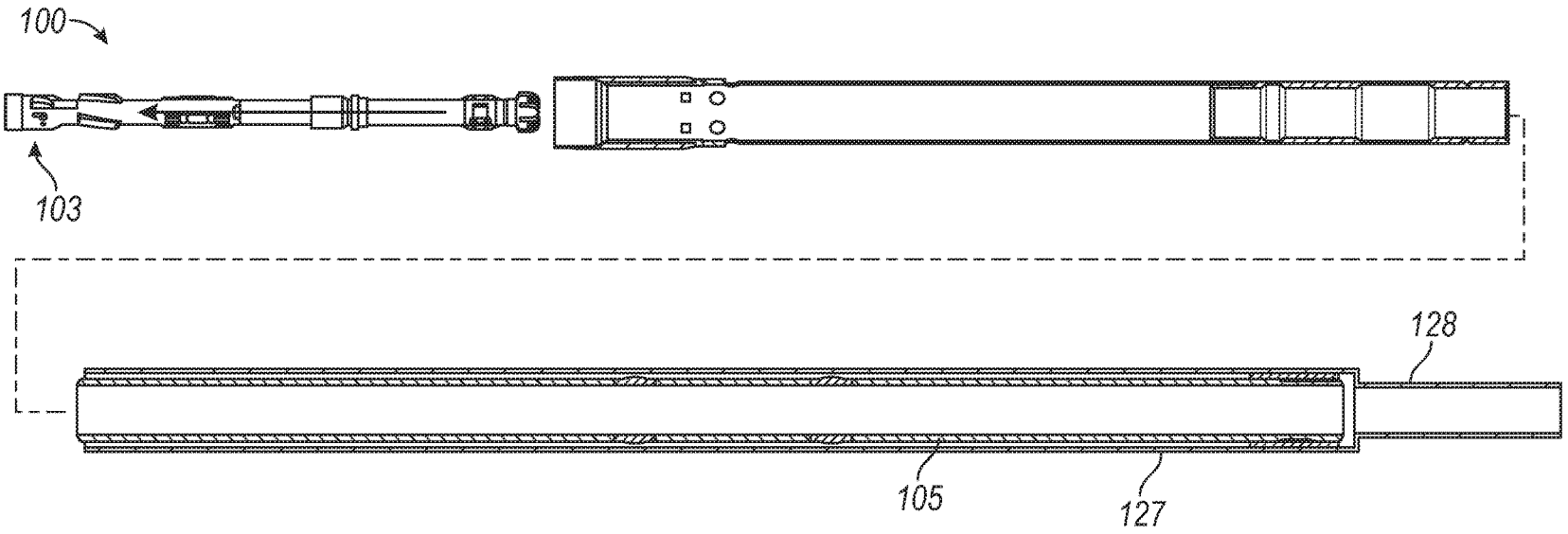

FIG. 13 illustrates the system 100 of FIG. 1 as the drill string/drill pipe 101 (see FIG. 1) is pulled out of the wellbore 127, with the bottomhole assembly 103 coupled thereto after completing a liner cementing operation. A second or subsequent run or trip may be made into the pilot hole 128 to polish the polished bore receptacle 117, to install and seal a liner top packer, or for other purposes, if desired.

Figure 14:
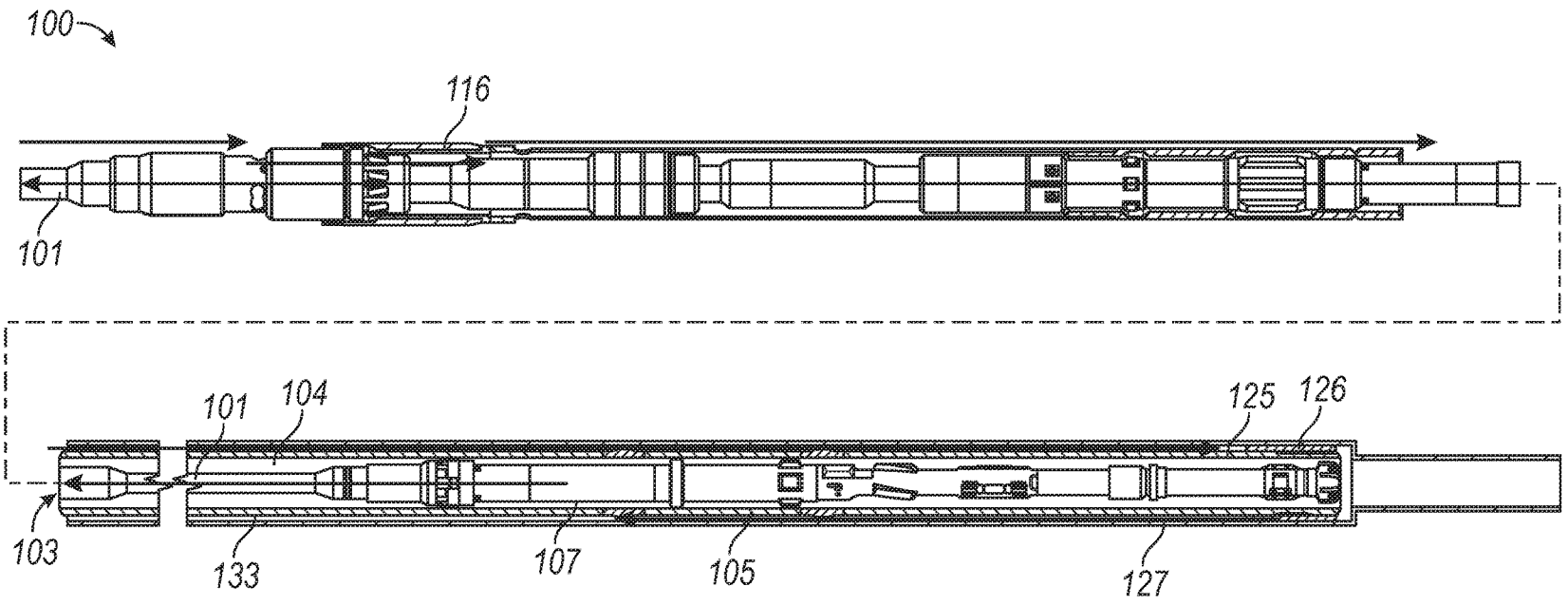
FIG. 14 is a partial cross-sectional view of the system of FIG. 1 during another method of cementing a liner, according to one or more embodiments.

In additional embodiments, the liner 105 may be cemented in a reverse cementing flow path rather than through the cementing flow path illustrated in FIG. 8. FIG. 14 illustrates a method of releasing the liner 105 and reverse cementing. In this method, the drill pipe 101 is picked up or raised slightly off bottom to set the liner hanger 116. The drill pipe 101 is then released from the liner 105. Drilling fluid or cement circulation may be then commenced along the reverse pathway shown in FIG. 14, in which the drilling fluid or cement may flow through the liner hanger 116 and through the annulus 133 between the liner 105 and the wellbore 127. Upon reaching the cement port collar 125, the drilling fluid or cement may flow radially inward through the cement port collar 125 and into the annulus 104 between the liner 105 and the drill pipe 101. The fluid may then flow uphole/upward in the annulus 104 to the lower diverter 107, and radially inward through the lower diverter 107, to the bore of the drill string 101 and BHA 103. Thus, cement or other fluid flow travels downhole through the annulus 133 between the liner 105 and the wellbore 127, uphole in the annulus 104 between the liner 105 and the drill pipe 101, through the lower diverter 107 and uphole through the bore of the drill string/drill pipe 101. It should be noted that rotation of the liner 105 is possible with a cement swivel and v-packing, or using a similar assembly proximate the liner shoe 124.

In additional embodiments, the annulus isolator 126 may be an internal annulus isolator such at that provided by a flapper valve or the like. For instance, the annulus isolator 126 may isolate the inner annulus 104 between the liner 105 and the drill string/drill pipe 101 or BHA 103.

Figure 15:
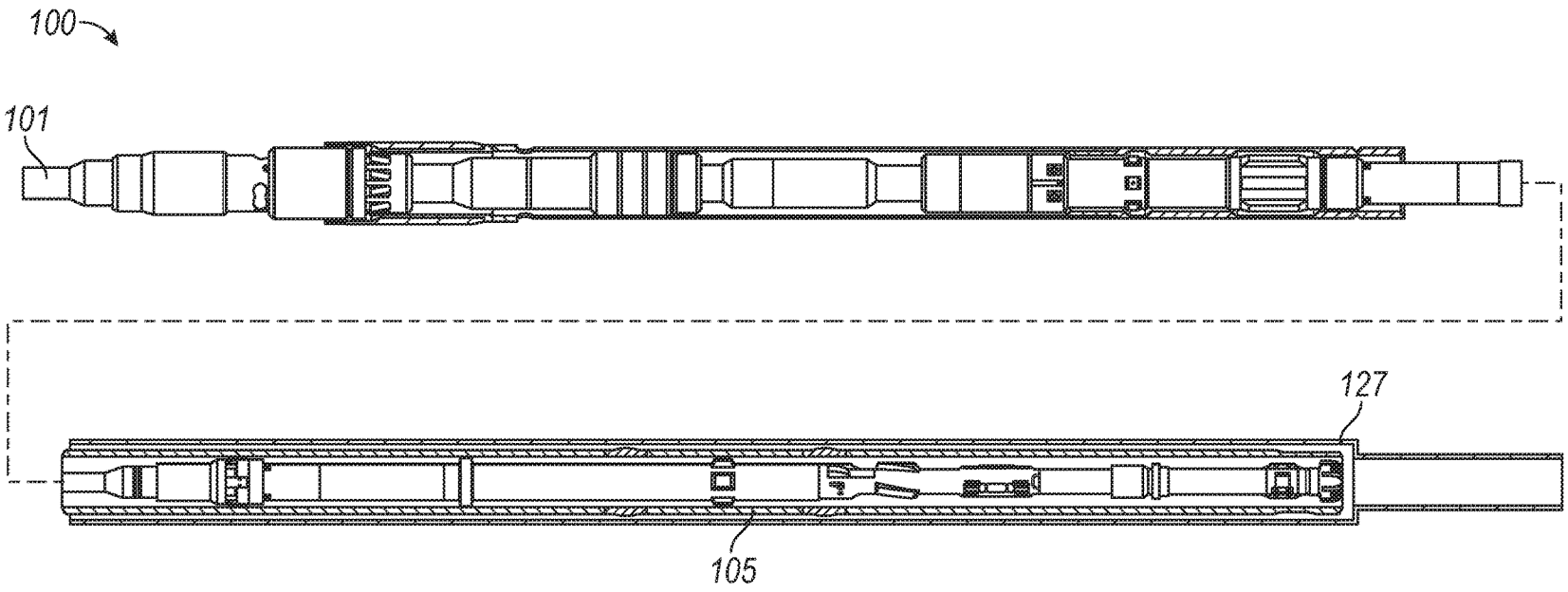
FIG. 15 is a partial cross-sectional view of another system for liner drilling and cementing in a single trip, according to one or more embodiments.

FIG. 15 illustrates another embodiment of a system 100 for liner drilling and cementing in a single trip. In this particular embodiment, the annulus isolator described herein (e.g., annulus isolator 126 described with respect to FIG. 6) is not be used, or may remain inactive. Likewise, portions of a method described with respect to FIG. 6 may not employed. With no active annulus isolator between the liner 105 and the wellbore 127, a cement port collar of the liner 105 may also not be used, or may be removed. Rather, an annulus isolator of FIG. 15 may be in a bore of the liner 105 between the liner 105 and the drill pipe 101, and may be a flapper valve or the like, as further described herein.

Figures 4, 16:
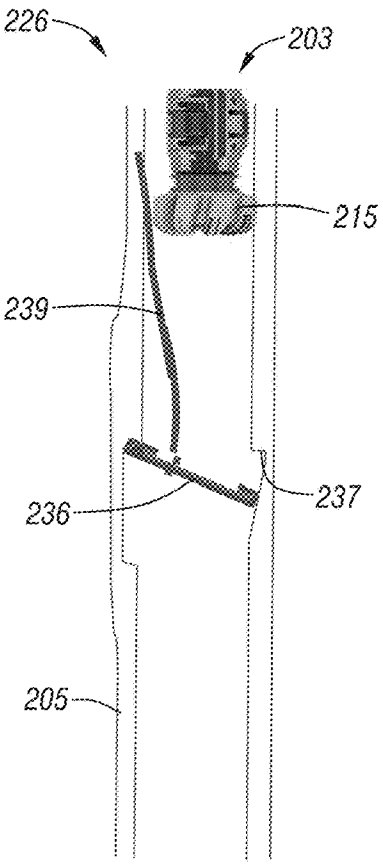
Figures 3, 16:
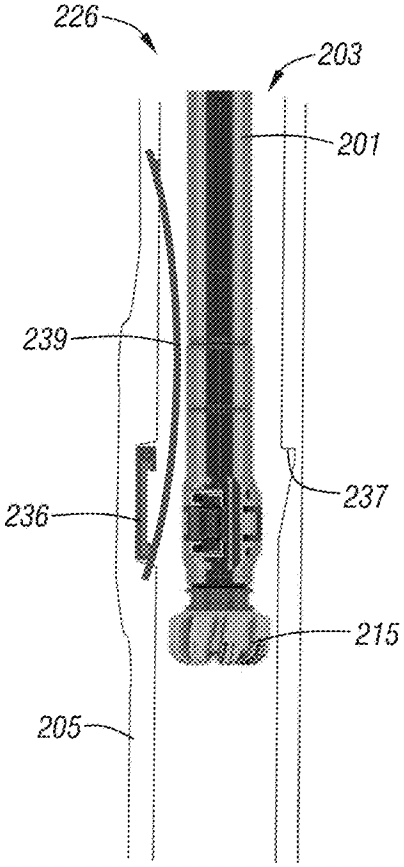
Figures 2, 16:
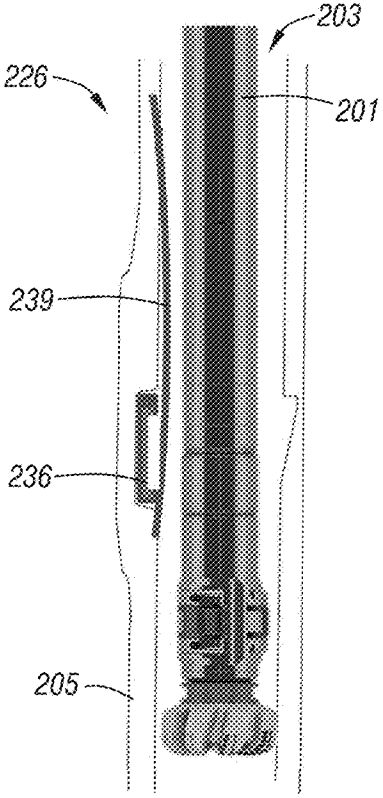
Figures 1, 16:
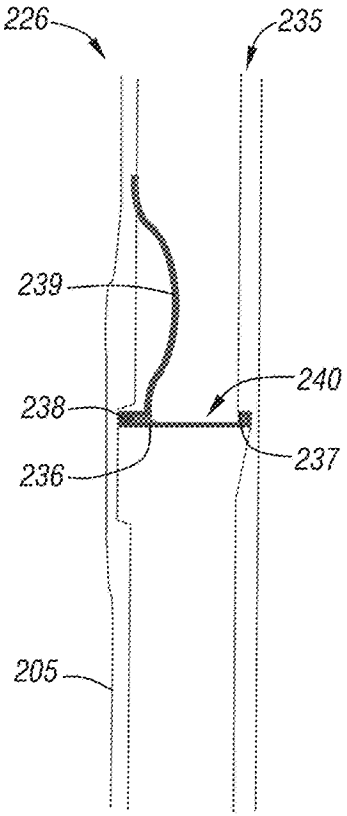

FIG. 16-1 illustrates one embodiment of an annulus isolator 226 that may be employed in the system of FIG. 15. As shown, a box and pin sub 235 may be disposed in the liner 205. Within the box and pin sub 235 is a valve disc or flapper valve 236, which may be movably coupled on one side portion to the liner 205 to move between an open position and a closed position. In the closed position, the valve disc or flapper valve 236 seats with a valve seat 237 to seal close the liner bore. The valve disc or flapper valve 236 may be movably coupled to the liner 205 by a spring loaded flapper pivot 238. The spring loaded flapper pivot 238 may be arranged to bias the valve disc or flapper valve 236 toward a closed position sealing off the liner bore. A bow spring 239 or other biasing device may be movable coupled to an uphole portion of the valve disc or flapper valve 236. The bow spring 239 may in some embodiments also be arranged, designed, or otherwise configured to bias the valve disc or flapper valve 236 toward the closed position. As shown, the bow spring 239 may be movably coupled to the valve disc/flapper valve 236 via a track 240 in the uphole portion of the valve disc/flapper valve 236. This track 240 permits the coupling point of the bow spring 239 to move radially when the valve disc/flapper valve 236 moves between open and closed positions. An upper end portion of the bow spring 239 may couple to an inner surface of the liner 205.

FIGS. 16-2 to 16-4 illustrate the annulus isolator 226 of FIG. 16-1 as it may be employed, according to one or more embodiments. FIG. 16-2 illustrates an embodiment in which, as a bottomhole assembly 203 is moved through the liner 205, the bottomhole assembly 203 or drill pipe 201 contacts the bow spring 239 and elongates the bow spring 239 in a downhole direction, thereby moving the valve disc/flapper valve 236 toward, and maintaining the valve disc/flapper valve 236 in, an open position. FIG. 16-3 illustrates an embodiment of the annulus isolator 226 in which contact between the bow spring 239 and the bottomhole assembly 203 (e.g., drill pipe 201) uphole of the valve seat 237 continues to maintain the valve disc/flapper valve 236 in the open position while the bottomhole assembly 203 and drill pipe 201 are withdrawn or raised uphole within the liner 205. This elongated bow spring 239 restricts, and potentially prevents, the valve disc or flapper valve 236 from moving inward and interfering with or contacting the tool joints or the drill bit 215. As illustrated in FIG. 16-4, once the drill bit 215 moves upwardly past the upper portion of the bow spring 239 (e.g., above the valve seat 237), the bow spring 237 may no longer be in contact with, or elongated by, the bottomhole assembly 203 or drill pipe 201. Therefore, the bow spring 239 returns to its original, biased position, which in turn closes the valve disc/flapper valve 236 against the valve seat 237. Due to the direction of movement of the valve disc/flapper valve 236 and the configuration of the valve seat 237, closing the bore of the liner 205 may create a seal that restricts and potentially prevents the flow of cement or other fluid from passing through the valve seat 237 in an upward direction (i.e., from below the valve seat 237).

Figure 17:
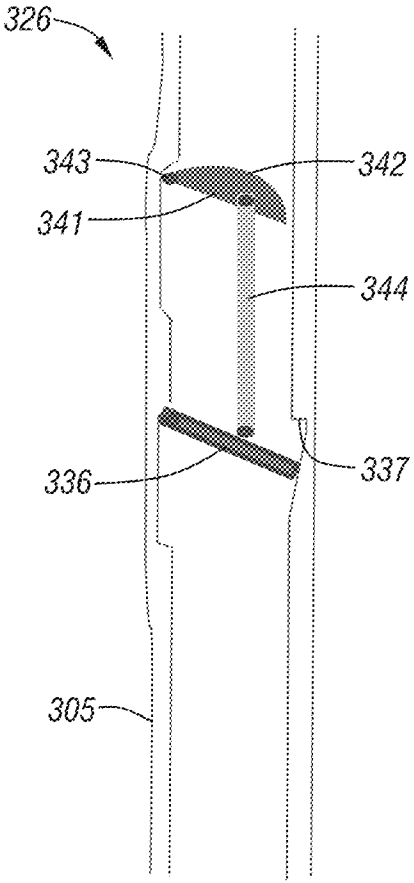
FIG. 17 is a schematic, side view of another annulus isolator that may be employed in the system of FIG. 15, according to one or more embodiments.

FIG. 17 illustrates another embodiment of an annulus isolator 326 that may be employed is the system 100 of FIG. 15. The annulus isolator 326 may be similar to the annulus isolator 226 of FIGS. 16-1 to 16-4 in that a valve disc or flapper valve (here referred to as valve cover 336) may be employed within a box and pin sub to close or isolate the bore of the liner 305 from the annulus between the liner 305 and a surrounding wellbore. Rather than a bow spring, the annulus isolator 326 of FIG. 17 employs a pivoting actuator 341 positioned uphole of and coupled to the valve cover 336. The valve cover 336 may be similar to the valve disc or flapper valve 236 of FIG. 16-1, and for conciseness will not be further described. The pivoting actuator 341 may have an uphole facing surface 342 that may be rounded or otherwise tapered to restrict or potentially prevent a bottomhole assembly from catching on its surface as the bottomhole assembly moves uphole or downhole across the pivoting actuator 341.

The pivoting actuator 341 may be movably coupled on one side portion to the liner 305 (e.g., via a spring loaded pivot 343, similar to the coupling of the valve cover 336). The spring loaded pivot 343 may be arranged to bias the pivoting actuator 341 toward an unactuated position, which seals off the liner bore by engaging the valve cover 336 against a valve seat 337. A link 344 or other coupling device or system may couple the pivoting actuator 341 to the valve cover 336 (e.g., through pivot connections with the pivoting actuator 341 and the valve cover 336). As the bottomhole assembly or drill pipe moves downhole across the pivoting actuator 341, a portion of the bottomhole assembly may contact a portion of the pivoting actuator 341 (e.g., the uphole facing surface 342), thereby pushing the pivoting actuator 341 it in a downhole direction and pivoting the pivoting actuator around the spring loaded pivot 343 into its actuated position. This pivoting movement of the pivoting actuator 341 may, in turn, moves the link downhole to move and maintain the valve cover 336 in an open position allowing flow through the bore of the liner 305. As those skilled in the art will readily recognize in view of the disclosure herein, as the bottomhole assembly or drill pipe is raised uphole through the liner 305, the bottomhole assembly will disengage the pivoting actuator 341, and the valve cover 336 will be allowed to return to a closed position.

Figures 4, 18:
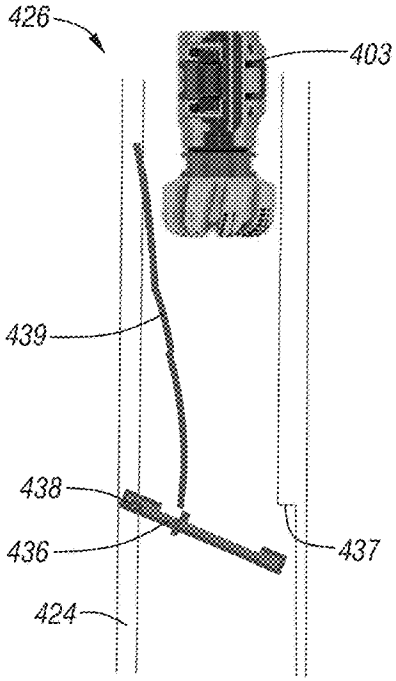
Figures 3, 18:
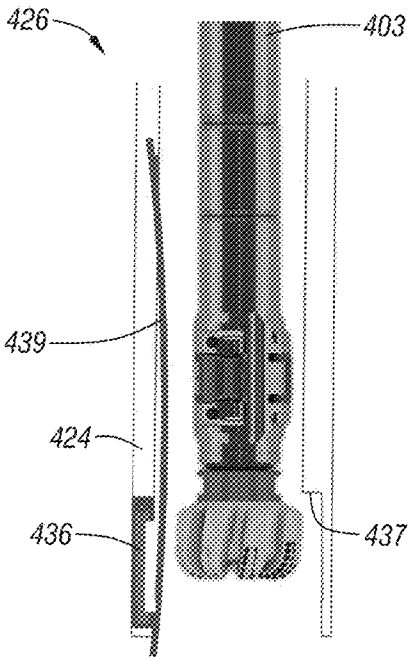
Figures 2, 18:
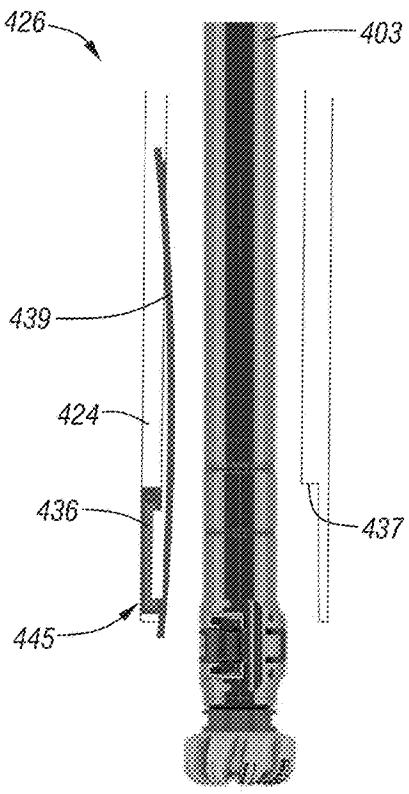
Figures 1, 18:
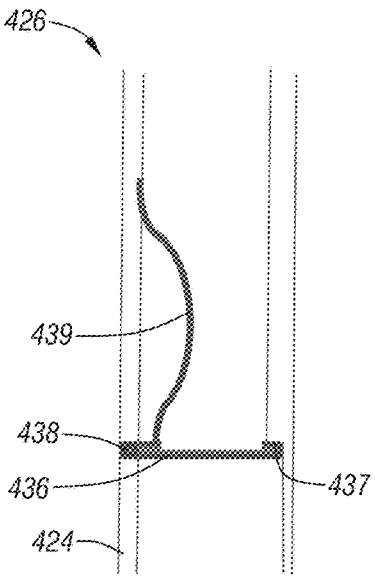

FIG. 18-1 illustrates another embodiment of an annulus isolator 426 that may be employed is the system 100 of FIG. 15. The annulus isolator 426 of FIG. 18-1 is similar in arrangement and function as the annulus isolator 226 described with respect to FIG. 16-1; however, the annulus isolator 426 of FIG. 18-1 is illustrated as part of a liner shoe 424 rather than as being within a box and pin sub. Another difference between the annulus isolator 426 of FIGS. 18-1 relative to the annulus isolator 226 of FIG. 16-1 is that the annulus isolator 426 of FIG. 18-1 may have a window 445 (see FIG. 16-2) in the inner sidewall of the liner shoe 424 for disposition of the valve cover 436 when such valve cover 436 is in an open position.

FIGS. 18-2 through 18-4 illustrate the annulus isolator 426 of FIG. 18-1 as it may be employed, according to one or more embodiments. As those skilled in the art will readily recognize in view of the disclosure herein, the methods and embodiments shown in FIGS. 18-2 to 18-4 are similar to the methods and embodiments shown in FIGS. 16-2 to 16-4. Thus, a bow spring 439 may be selectively contacted and flexed by a BHA 403 to cause the valve cover 436 to pivot about a pivot 438 within the liner shoe 424. When the valve cover 426 is in the open position (see FIGS. 18-2 and 18-3), flow may pass through an interior or bore of the liner shoe 424. When the valve cover 426 is in a closed position (see FIG. 18-1), the valve cover 426 may be engaged against a valve seat 437 and flow may be restricted or even prevented in one or more directions through the interior or bore of the liner shoe 424. For instance, in the illustrated orientation, the closed position of the valve cover 426 may restrict upward directed flow.

Figure 19:
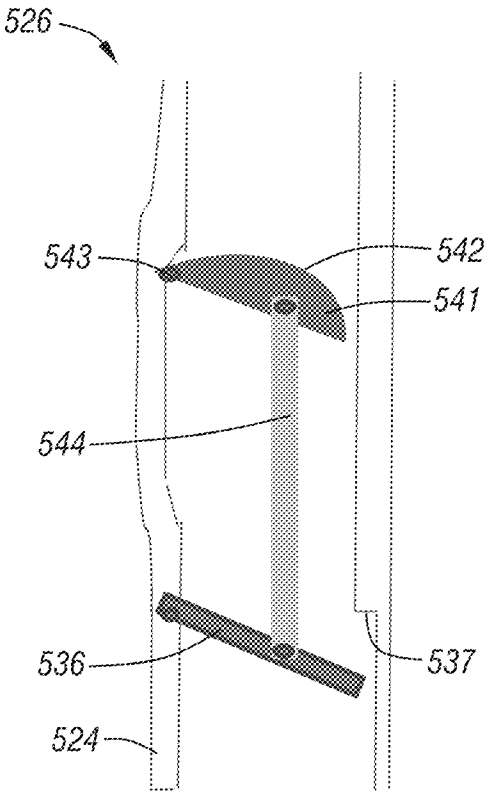
FIG. 19 is a schematic, side view of still another annulus isolator that may be employed in the system of FIG. 15, according to one or more embodiments.

FIG. 19 illustrates another embodiment of an annulus isolator 526 that may be employed in the system 100 of FIG. 15. The annulus isolator 526 of FIG. 19 is similar to the annulus isolator 426 of FIG. 18-1 in that a valve disc or flapper (valve cover 536) may be selectively used within a liner shoe 524 to close or isolate the bore of the liner from the annulus between the liner and the wellbore. Rather than a bow spring, the annulus isolator 526 of FIG. 19 employs a pivoting actuator 541 positioned uphole of and optionally coupled to the valve cover 536. The valve cover 536 is similar to the valve cover 436 of FIG. 18-1, and for the sake of conciseness will not be further described. The pivoting actuator 541 may have uphole facing surface 542 that is optionally tapered or rounded to restrict, and potentially prevent, the bottomhole assembly from catching upon its surface as the bottomhole assembly moves uphole and downhole across the pivoting actuator 541. The pivoting actuator 541 may be movably coupled on one side portion to the liner shoe 524 via a spring loaded pivot 543, similar to the coupling of the valve cover 536. The spring loaded pivot 543 may be arranged to bias the pivoting actuator 541 toward an unactuated, closed position, which seals off the bore of the liner shoe 524. A link 544 or coupling device may couple the pivoting actuator 541 to the valve cover 536 (e.g., through a pivot or hinged connection on the pivoting actuator 541 and through a pivot or hinged connection on the valve cover 536). As the bottomhole assembly or drill pipe moves downhole across the pivoting actuator 541, a portion of the bottomhole assembly contacts a portion of the pivoting actuator 541 (e.g., the uphole facing surface 542) pushing the pivoting actuator 541 in a downhole direction and pivoting the pivoting actuator 541 into an actuated, open position. This pivoting movement of the pivoting actuator 541 may, in turn, move the link 544 downhole to move and maintain the valve cover 536 in the open, actuated position. As those skilled in the art will readily recognize in view of the disclosure herein, as the bottomhole assembly or drill pipe is raised uphole through the liner shoe 524, the bottomhole assembly or drill pipe will disengage the pivoting actuator 524, and the valve cover 536 may return to the unactuated, closed position against the valve seat 537.

Figure 20:
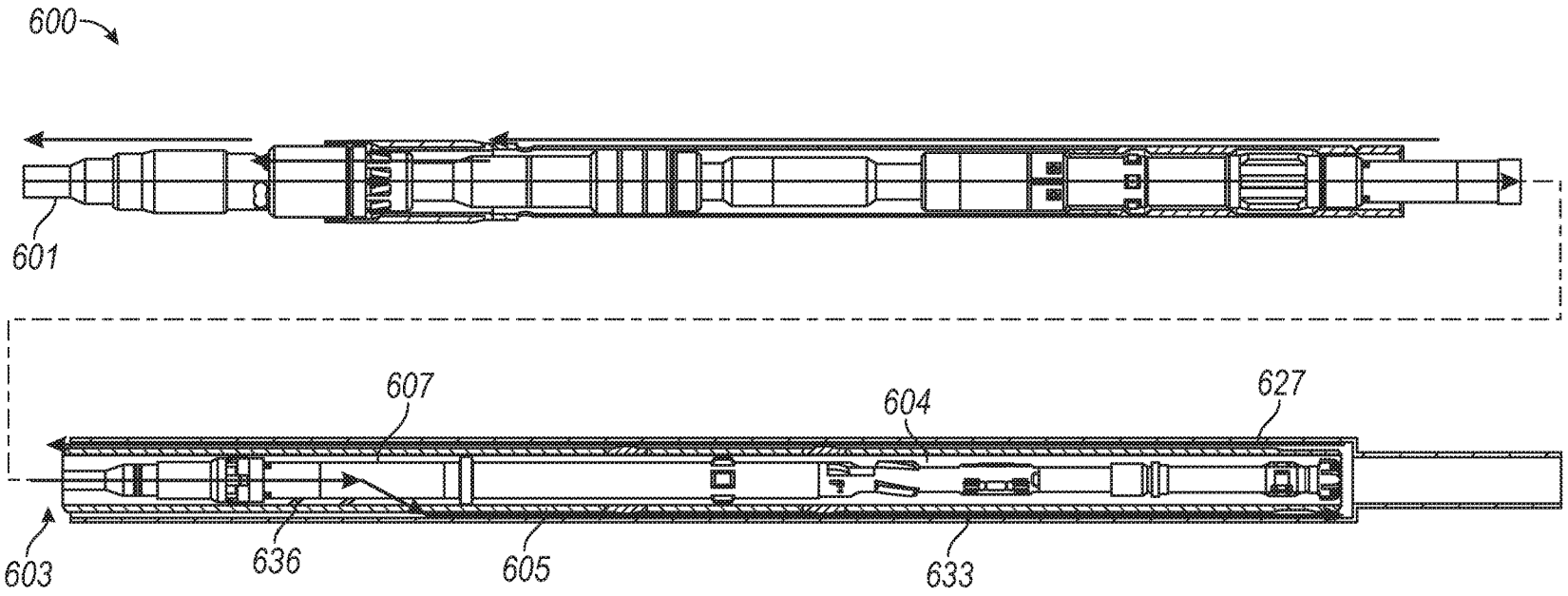
FIGS. 20 to 23 are partial cross-sectional views of the system of FIG. 15 during performance of a method for liner drilling and cementing in a single trip, according to one or more embodiments.

FIGS. 20-23 illustrate a method for liner drilling and cementing in a single trip while employing a system 600 similar to the system of FIG. 15, according to one or more embodiments of the present disclosure. In particular, FIG. 20 illustrates a flapper valve 636 according to an embodiment shown in FIG. 17. The internal flapper valve 636, movably coupled to the liner 605 and residing in the bore of the liner 605, may have an upper pivoting actuator and a lower valve disc as described herein. The internal flapper valve 636 may be held open by the drill pipe 601 or bottomhole assembly 603 while the drill pipe 601 or bottomhole assembly 603 is positioned downhole of the internal flapper valve 636. Cement (shown by the downward arrows) may flow downward through the bore of the drill pipe 601, radially outward through the lower diverter 607, and downward through the annulus 604 between the liner and the drill pipe 601 or bottomhole assembly 603. The cement then flows out of the bottom end portion of the liner 605 and upward through the annulus 633 between the liner 605 and the wellbore 627. While the flapper valve 636 in the embodiment shown in FIG. 20 may include the valve shown in FIG. 17, those skilled in the art will readily recognize in view of the disclosure herein that any of the embodiments of flapper valves or similar disclosed herein may be employed.

Figure 21:
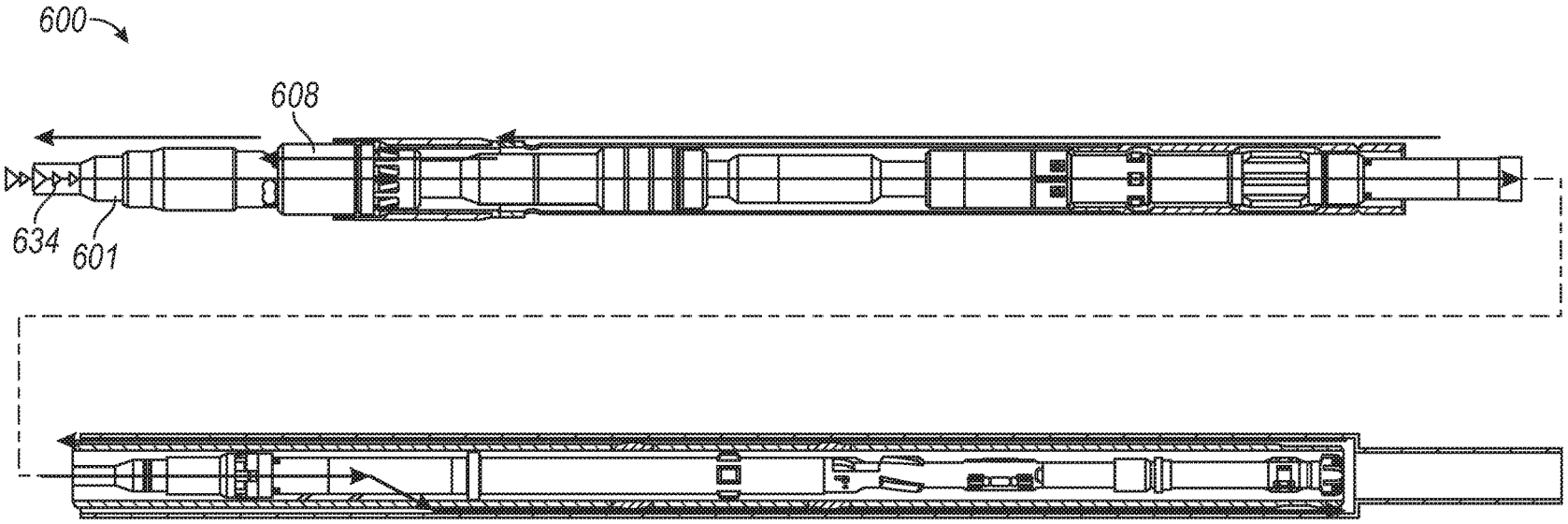

FIG. 21 illustrates the system 600 of FIG. 20, with a dart 634 or other obstruction device positioned behind the cement within the bore of the drill pipe 601, such that displacement fluid may be pumped downhole behind the dart 634, as described elsewhere herein. The dart 634 or other obstruction device or wiper tool may wipe the bore of the drill string, including the running tool 608 and the drill pipe 601.

Figure 22:
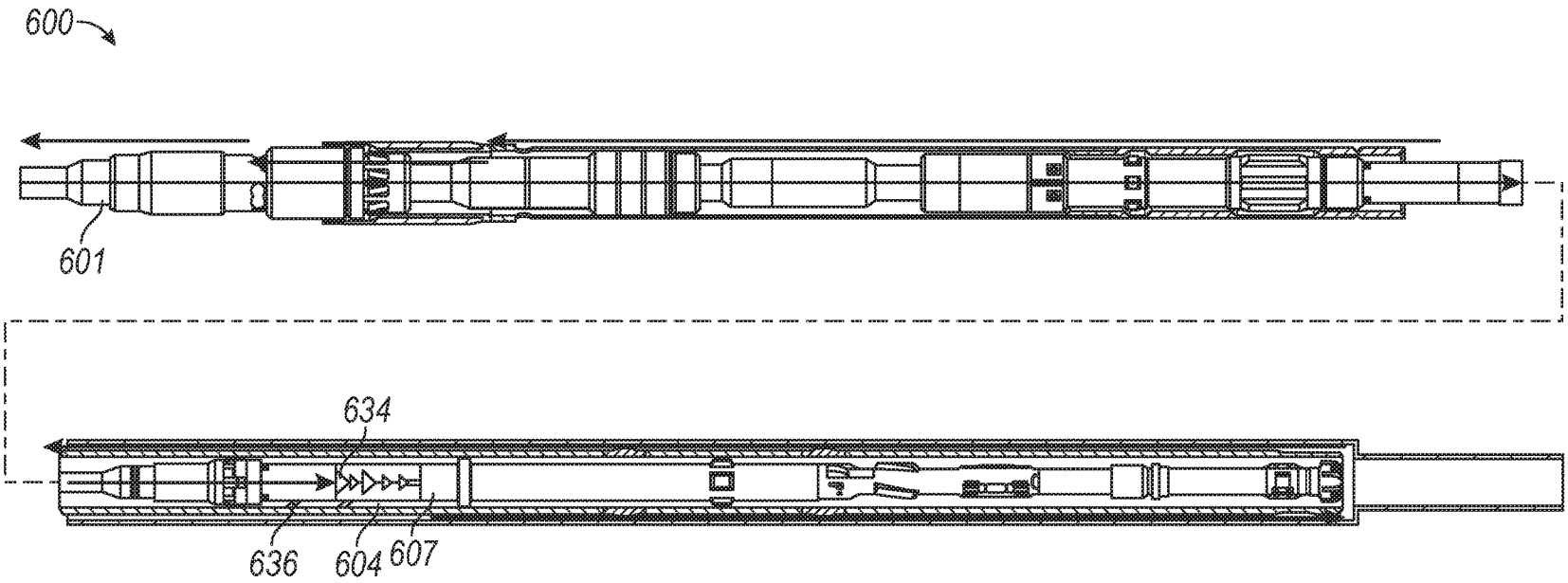

FIG. 22 illustrates the system 600 of FIG. 20 with the dropped dart 634 landing into a profile in the lower diverter 607. The landed dart 634 may plug openings that open to the annulus 604, through which cement was previously flowing. This causes an increase in fluid pressure in the bore of drill sting/drill pipe 101, which confirms full displacement.

Figure 23:
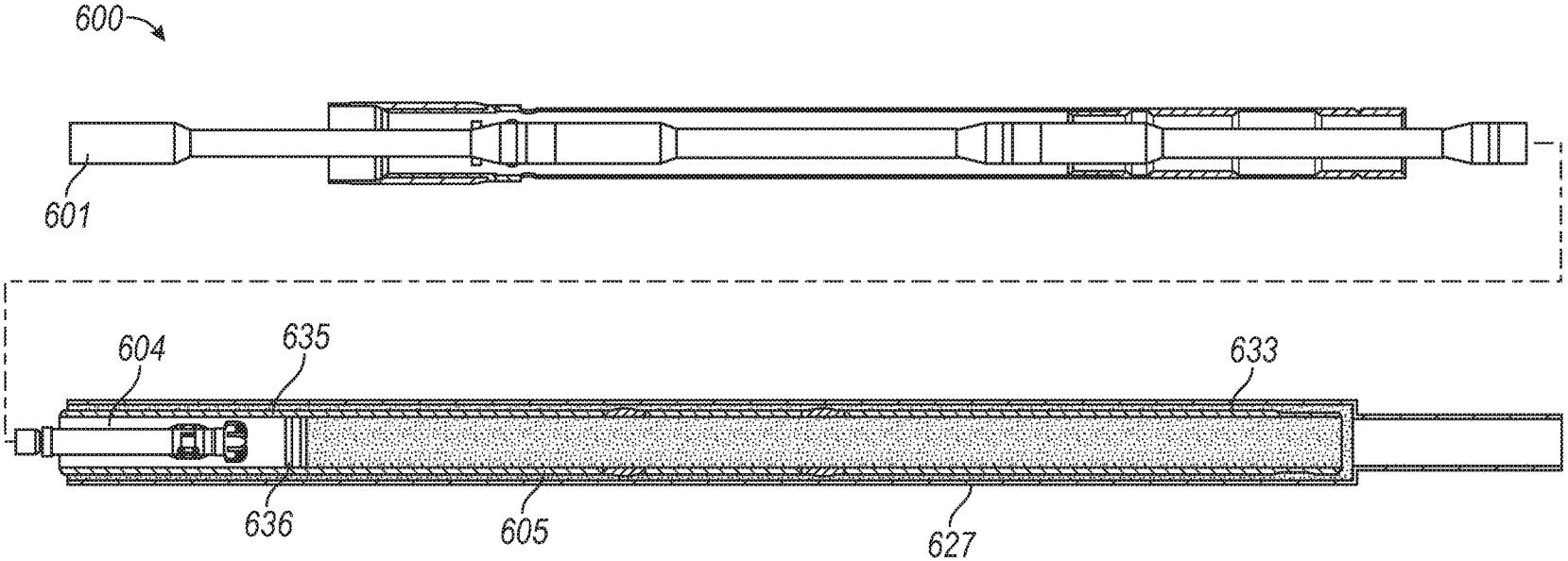

FIG. 23 illustrates the employment of the internal flapper valve 636 to restrict and potentially prevent cement from flowing thereabove in the bore of the liner 605 after the drill pipe 101 and bottomhole assembly 603 are raised uphole of the internal flapper valve 636, while cement may flow above the flapper valve 636 within the annulus 630 between the liner 605 and the wellbore 627. The raising of the bottomhole assembly 603 above the internal flapper valve 636 allows the flapper valve 636 to shut, thereby isolating the bore of the liner 605 from the annulus 633 (i.e., between the liner 605 and the wellbore 627). In this particular embodiment, the internal flapper valve 636 is in a box and pin sub 635 a distance uphole of the bottom end portion of the liner 605. Therefore, cement may be permitted to "U" tube uphole within the bore of the liner 605 to the internal flapper valve 636. The pressure in the drill pipe 101 and drill string may be increased to shift the landed dart 636 (see FIG. 22) in the lower diverter 607 (see FIG. 22) to once again divert flow to the annulus 604. This permits fluid circulation through the drill pipe 601 and into the annulus 604 at the lower diverter 607, as described herein, while withdrawing the bottomhole assembly 603 from the wellbore 627.

According to some embodiments of the present disclosure, a single trip drilling, liner setting, and cementing system may be used. According to at least some embodiments, the single-trip system may allow retrieval of the bottomhole assembly used to drill the wellbore. Due to the single-trip system architecture, setting the liner hanger and cementing the liner can be efficiently performed. As the liner may be cemented immediately or soon after drilling, sloughing or filling of the annulus between the liner and the wellbore wall is minimized, and cement can efficiently be circulated into the annulus.

While liner drilling assemblies are described herein may be used in connection with oil and gas drilling, exploration, and recovery efforts, such embodiments are not limited to such use. In other embodiments, liner drilling systems or components discussed herein, or which would be appreciated by a person having ordinary skill in the art in view of the disclosure herein, may be used in other applications, environments or industries. For instance, similar assemblies, systems, and methods may be used in connection with exploration or drilling for water, placement of utility lines, and the like.

Relational terms may be used to differentiate between similar components; however, descriptions may also refer to certain components or elements using designations such as "first," "second," "third," "upper," "lower," and the like. Such language is also provided for differentiation purposes, and is not intended limit a component to a singular designation or position. As such, a component referenced in the specification as the "first" component may include the same component that may be referenced in the claims as a "second," "third," or other component. Furthermore, to the extent the specification or claims refer to "an additional" or "other" element, feature, aspect, component, or the like, it does not preclude there being a single element, feature, aspect, or component. The terms "a" or "an" are open-ended and are intended to be inclusive of other components and understood as "one or more" of a corresponding element, feature, benefit, component, or the like. A component, feature, structure, or characteristic described herein should not be interpreted as being required or essential unless explicitly described as such for all embodiments.

The terms "couple" or "coupled", or similar terms such as "attach" and "attached," "connect" and "connected," "mount" and "mounted," and "secure" and "secured," are intended to include direct and indirect connections. Thus, terms that are coupled or otherwise connected together may have no intervening components, or may have one or more intervening components that create the connection. Components that are integrally formed as a singular monolithic body should also be considered to be coupled together. The term "may," as used herein, indicates that features that are present in some embodiments, but which are not present in other embodiments.

Meanings of technical and scientific terms used herein are to be understood as by a person having ordinary skill in the art to which embodiments of the present disclosure belong, unless otherwise defined. Embodiments of the present disclosure can be implemented in the testing or practice with methods and materials equivalent or similar to those described herein. Thus, although the foregoing description contains many specifics, these should not be construed as limiting the scope of the disclosure or of any of the appended claims, but merely as providing information pertinent to some specific embodiments that may fall within the scope of the disclosure and the appended claims. Any features from different embodiments may be employed in combination. In addition, other embodiments of the present disclosure may also be devised which lie within the scopes of the disclosure and the appended claims, including any equivalent structures or structural equivalents. Additions, deletions and modifications to example embodiments, as disclosed herein, that fall within the meaning and scopes of the claims, are to be embraced by the claims.

While the foregoing is directed to embodiments of various techniques disclosed herein, other and further embodiments may be devised without departing from the basic scope thereof. Although the subject matter has been described in language specific to structural features and/or methodological acts, it is to be understood that the subject matter defined in the appended claims is not limited to the specific features or acts described above. Rather, the specific features and acts described above are disclosed as example forms of implementing the claims.

What is claimed is:

1. A method of drilling, comprising, drilling at least a portion of a wellbore while running a liner into the wellbore, the liner coupled to a drill string extending through a bore of the liner, the drill string coupled to a drill bit, and the drill string and the liner defining a liner annulus radially therebetween;

isolating the bore of the liner from a wellbore annulus defined radially between the liner and the wellbore;

establishing a downhole cement path through a bore of the drill string and into the liner annulus through at least one diverter;

hanging the liner from a liner hanger within the wellbore;

decoupling the liner from the drill string;

pumping cement along the cement path, the cement path extending downhole through the liner annulus, radially outward through the liner, and at least partially uphole into the wellbore annulus, wherein pumping cement along the cement path extending radially outward through the liner includes increasing fluid pressure in the liner annulus and thereby opening a cement port incorporated in a body of an annulus isolator isolating the bore of the liner from the wellbore annulus;

pumping a displacement fluid along the cement path and thereby displacing the cement at least partially into the wellbore annulus; and withdrawing the drill string and drill bit from the wellbore, the method accomplished in a single downhole trip.

2. The method of claim 1, further comprising retracting the drill bit into the bore of the liner.

3. The method of claim 1, wherein the isolating of the bore of the liner includes sealing the wellbore annulus using a flapper valve coupled to the liner.

4. The method of claim 3, wherein sealing the wellbore annulus using a flapper valve includes engaging the drill string against the flapper valve to thereby open the flapper valve and disengaging the drill string against the flapper valve when retracting the drill string above the flapper valve to thereby close the flapper valve and isolate the wellbore annulus from the bore of the liner.

5. The method of claim 4, wherein the engaging the drill string against the flapper valve includes engaging the drill string against a bow spring of the flapper valve, and wherein engaging the bow spring opens a valve cover of the flapper valve.

6. The method of claim 5, wherein engaging the bow spring moves the bow spring along a track of the valve cover.

7. The method of claim 5, wherein opening the valve cover includes pivoting the valve cover from a closed position to an open position.

8. The method of claim 4, wherein engaging the drill string against the flapper valve includes engaging the drill string against a pivoting actuator.

9. The method of claim 8, the pivoting actuator being linked to a pivoting valve cover, such that engagement of the drill string against the pivoting actuator causes the pivoting actuator and the pivoting valve cover to each pivot to an open position.

10. The method of claim 8, the pivoting actuator having a tapered upper surface.

11. The method of claim 4, wherein disengaging the drill string against the flapper valve includes using a bias of the flapper valve to close the flapper valve.

12. The method of claim 1, wherein isolating of the bore of the liner is accomplished with an inflatable packer in the wellbore annulus.

13. A system for drilling, hanging liner, and cementing in a single trip, comprising:

a liner releasably coupled to a drill string, the drill string extending through an axial bore of the liner, the drill string including a bottomhole assembly and a drill bit at a downhole end portion thereof and arranged and designed to rotate to at least partially drill a wellbore, the drill string and the liner defining a liner annulus radially therebetween;

a liner shoe coupled to the liner;

an annulus isolator coupled to the liner, positioned in the liner shoe, and arranged and designed to isolate flow within the bore of the liner from flowing through at least a portion of a wellbore annulus defined between the liner and the wellbore; and a diverter in the drill string uphole of the bottomhole assembly, the diverter establishing a cement path into the liner annulus.

14. The system of claim 13, the at least one diverter establishing a radial cement path from the drill string in the bore of the liner to the liner annulus.

15. The system of claim 13, the annulus isolator being positioned uphole of the diverter.

16. The system of claim 13, the annulus isolator arranged and designed to bias to a closed position when the liner is released from the drill string and the drill string is withdrawn to an axial position uphole of the annulus isolator.

17. The system of claim 16, the annulus isolator including a flapper valve pivotally coupled to the liner and positioned within the bore of the liner.

18. The system of claim 17, the annulus isolator including a bow spring coupled to the flapper valve and movable along a track in the flapper valve, the bow spring arranged and designed to elongate upon contact with the drill string to pivot the flapper valve to an open position.

19. The system of claim 17, the annulus isolator including a pivoting actuator coupled to the flapper valve by a pivoting link, the pivoting actuator arranged and designed to pivot upon contact with the drill string to use the link to pivot the flapper valve to an open position.

* * * * *